US011694529B1

(12) United States Patent
Müller et al.

(10) Patent No.: US 11,694,529 B1
(45) Date of Patent: Jul. 4, 2023

(54) ANTI-THEFT SECURITY SYSTEM AND METHOD TO OPERATE THE ANTI-THEFT SECURITY SYSTEM

(71) Applicant: rapitag GmbH, Munich (DE)

(72) Inventors: Sebastian Müller, Munich (DE); Alexander Schneider, Munich (DE)

(73) Assignee: RAPITAG GMBH, Munich (DE)

( * ) Notice: Subject to any disclaimer, the term of this patent is extended or adjusted under 35 U.S.C. 154(b) by 0 days.

(21) Appl. No.: 17/838,397

(22) Filed: Jun. 13, 2022

(51) Int. Cl.
*G08B 13/22* (2006.01)

(52) U.S. Cl.
CPC ..... *G08B 13/22* (2013.01)

(58) Field of Classification Search
CPC ..... G08B 13/22
See application file for complete search history.

(56) References Cited

U.S. PATENT DOCUMENTS

| | | | | |
|---|---|---|---|---|
| 9,024,750 | B2 * | 5/2015 | Defant | H04W 4/02 340/539.31 |
| 10,217,337 | B1 * | 2/2019 | Marszalek | G08B 13/24 |
| 2014/0073262 | A1 * | 3/2014 | Gutierrez | G08B 13/22 455/67.11 |
| 2015/0126234 | A1 * | 5/2015 | Rodriguez | H04M 1/72412 455/457 |
| 2015/0279196 | A1 * | 10/2015 | Tajima | G08B 21/24 340/568.1 |
| 2016/0371893 | A1 * | 12/2016 | Busch-Sorensen | G07C 9/28 |
| 2017/0306657 | A1 | 10/2017 | Schneider | |
| 2023/0078212 | A1 * | 3/2023 | Sugashima | B60R 25/34 |

FOREIGN PATENT DOCUMENTS

| | | | |
|---|---|---|---|
| WO | 2016055446 | A1 | 4/2016 |
| WO | 2020165038 | A1 | 8/2020 |
| WO | 2020178054 | A1 | 9/2020 |
| WO | 2020200618 | A1 | 10/2020 |
| WO | 2021160710 | A1 | 8/2021 |

* cited by examiner

*Primary Examiner* — Travis R Runnings
(74) *Attorney, Agent, or Firm* — Kilpatrick Townsend & Stockton LLP

(57) ABSTRACT

A first functionality of anti-theft security system infrastructure provides at least signal reception capabilities and enables the anti-theft security system infrastructure to detect mobile anti-theft devices by receiving advertising signals therefrom and to hand over a respectively detected mobile anti-theft device to a second functionality of the anti-theft security system infrastructure, wherein the second functionality provides at least signal transmission capabilities and enables the anti-theft security system infrastructure to communicate with an handed-over mobile anti-theft device including the sending of a release command to the handed-over anti-theft device, automatically after the handing-over or if at least one release condition is fulfilled.

27 Claims, 3 Drawing Sheets

ANTI-THEFT SECURITY SYSTEM AND METHOD TO OPERATE THE ANTI-THEFT SECURITY SYSTEM

The present invention relates to anti-theft security systems and mobile anti-theft devices belonging to anti-theft security systems and to point-of-sales systems interacting with or comprising an anti-theft security system, as is disclosed and discussed for example in WO 2016/055446 A1 and corresponding US 2017/0306657 A1, in WO 2020/165038 A1, in WO 2020/178054 A1 and in WO 2020/200618 A1. The complete disclosure of these publications is included by reference into the present disclosure.

Mobile anti-theft devices have been preferentially used for many years in the field of stores open to the public, as they provide sufficient protection against unauthorized removal from the store, or from or a demarcated sales area within said store, of merchandise sold therein. For this purpose, appropriate detector units are usually provided at all entrances and exits of the store, or of any demarcated sales areas therein, and these are designed and intended to emit an acoustic and/or visual warning signal if a customer attempts to remove any protected merchandise to which an anti-theft device of this kind is attached from the store or sales area without authorization, i.e., without paying for it beforehand.

Particularly well-known is the use of mobile anti-theft device in the field of textile products. Anti-theft devices of this kind usually comprise a multi-part housing and a locking mechanism, which has a needle that, when in a locked state, engages with the merchandise to be protected in such a way that the anti-theft device cannot be removed from the merchandise to be protected, or at least not without destroying the merchandise to be protected in the process.

If, for example, an anti-theft device of this kind is provided with a two-part housing, then in order to assemble the anti-theft device on the textile product to be protected a first housing part is usually attached to the outside of the textile product and a second housing part is attached to a corresponding internal side of the textile product, and the textile product part located in between the two housing parts is pierced by a needle that, for example, has been attached beforehand to one of the two housing parts, in such a way that the needle can latch to the other of the two housing parts, thereby interconnecting the textile product and the two housing parts by means of the needle.

To open the locking mechanism of an anti-theft device that is attached to a textile product in this way, in the customer service or checkout area of a store there are usually appropriate unlocking devices which can generally be operated only by the sales staff, are magnetic or have another kind of mechanical action, and are designed and intended to release the locking mechanism of the anti-theft device such that the needle can be removed from the anti-theft device and the two housing parts of the anti-theft device can be separated from each other again.

Other kinds of mobile anti-theft devices are available for protecting bottles, card boxes and various other kinds of merchandise.

State of the art anti-theft devices do not require manual or magnetic interaction with a dedicated unlocking device in a customer service or checkout area, but can be unlocked based on wireless signal communication. Such a mobile anti-theft device typically includes:

an electro-mechanical fixation arrangement, which enables the mobile anti-theft device to be fixedly attached to a merchandise item in a fixation state and enables the mobile anti-theft device to be detached or allow detachment from a merchandise item in a release state, a wireless signal reception arrangement, which is configured to receive wireless signals, a controller which is configured to interact with the electro-mechanical fixation arrangement and the wireless signal reception arrangement, wherein the controller is configured to react to commands received as wireless signals by the wireless signal reception arrangement, including to operate the electro-mechanical fixation arrangement to switch-over from the fixation state to the release state in response to a received release command.

Such mobile anti-theft devices may appropriately be denoted as smart (mobile) anti-theft devices.

Typically, an anti-theft security system or a point-of-sales system having an anti-theft security function will typically comprise a plurality of such mobile anti-theft devices, together with superordinate anti-theft security system or superordinate point-of-sales system infrastructure having wireless signal transmission and reception capabilities. For a point-of-sales system having an anti-theft security function the terms "superordinate anti-theft security system infrastructure" and "superordinate point-of-sales system infrastructure" may be used synonymously in the context of the present disclosure. In this case, also the terms "point-of-sales system" and "anti-theft security system" may be used synonymously in the context of the present disclosure.

This superordinate infrastructure can wirelessly interact with a respective mobile anti-theft device, directly or via another wirelessly enabled device, for example a personal mobile device of a customer, such as the customer's smartphone. The latter makes particular sense according to modern payment and check-out concepts. For example, an application (app), which is configured to communicate with such an anti-theft device, could be installed on the smartphone. Using this smartphone software, goods information could be read out, transactions could be triggered and the needed release command for unlocking the anti-theft device could forwarded to the anti-theft device. Customers without a corresponding mobile device could release the anti-theft device at a special self-service terminal or a similar element of the superordinate infrastructure.

The wireless communication between the superordinate infrastructure and the mobile anti-theft devices or/and between the superordinate infrastructure and the personal mobile devices or/and between the respective personal mobile device and the respective mobile anti-theft device may be based on various wireless communication and wireless signal transmission standards, such as a WIFI standard or an NFC standard or a Bluetooth standard or any other short-range or near field communication standard. Wireless communications between the superordinate infrastructure and the personal mobile devices could also be achieved in an optical manner in principle, e.g. using a camera of the superordinate infrastructure and a display of the personal mobile device or/and using camera of the personal mobile device and a display of the superordinate infrastructure. Alternatively, the superordinate infrastructure and the personal mobile devices could interact via the internet.

For example, the personal mobile device could communicate via a public WIFI network or a cellular communications network and via the internet with the superordinate infrastructure. This is particularly appropriate in most cases, and also in case that a remote server, possibly a cloud server, is provided. Such a remote server may be configured to interact with and possibly control the superordinate infrastructure by means of data communication via a communications network, e.g. the internet, and may be configured to interact by means of data communication via a communications network, typically the internet, with such a personal mobile device. From a functional point of view, such a remote server may appropriately be considered to belong to the anti-theft security system or to the point-of-sales system or the superordinate infrastructure of the respective system. However, in case of a chain of shops or similar, such a remote server will typically be configured to interact by means of data communication via the communications network, e.g. the internet, with plural anti-theft security systems or plural point-of-sales system deployed in plural respective shops.

Aspects of the present invention concern check-out and point-of-sales scenarios involving such personal mobile devices as well as check-out and point-of-sales scenarios not involving such personal mobile devices. As far as such personal mobile devices are involved, the present invention concerns inter alia situations in which a respective personal mobile device is technically incapable or is not configured to interact wirelessly with a respective mobile anti-theft device. Such a personal mobile device may nevertheless interact with the superordinate infrastructure or a remote server associated to the superordinate infrastructure for payment and checkout purposes, but the superordinate infrastructure may interact directly with the respective mobile anti-theft device, possibly based on commands and data received from the remote server.

According to a first aspect of the present invention, it is an object of the invention to provide an anti-theft security system or a point-of-sales system having an anti-theft security function, which can wirelessly interact with mobile anti-theft devices in an efficient manner.

According to a second aspect of the present invention, it is an object of the invention to provide an anti-theft security system or a point-of-sales system having an anti-theft security function, which enables efficient check-out scenarios including efficient unlocking scenarios for the mobile anti-theft devices.

For achieving at least one of these objects, the present invention provides an anti-theft security system, comprising:

superordinate anti-theft security system infrastructure having wire-less signal transmission and reception capabilities, a plurality of mobile anti-theft devices, which are configured to be attached to merchandise items to be protected and to wirelessly interact with the superordinate anti-theft security system infrastructure, wherein a respective anti-theft device includes:

an electro-mechanical fixation arrangement, which enables the mobile anti-theft device to be fixedly attached to a merchandise item in a fixation state and enables the mobile anti-theft device to be detached or allow detachment from a merchandise item in a release state, a wireless signal transmission and reception arrangement, which is configured to receive wireless signals from the superordinate anti-theft security system infrastructure and to transmit wireless signals to the superordinate anti-theft security system infrastructure, wherein said wireless signals include advertising signals indicating the presence and availability for communication of the respective mobile anti-theft device, a controller which is configured to interact with the electro-mechanical fixation arrangement and the wireless signal transmission and reception arrangement, wherein the controller is configured to react to commands received as wireless signals from the superordinate anti-theft security system infrastructure by the wireless signal transmission and reception arrangement, including to operate the electro-mechanical fixation arrangement to switch-over from the fixation state to the release state in response to a release command received from the anti-theft security system infrastructure;

wherein the wireless signal transmission and reception capabilities are provided by plural functionalities of the superordinate anti-theft security system infrastructure, wherein a first functionality of the superordinate anti-theft security system infrastructure provides at least signal reception capabilities and enables the superordinate anti-theft security system infrastructure to detect mobile anti-theft devices by receiving advertising signals therefrom and to hand over a respectively detected mobile anti-theft device to a second functionality of the superordinate anti-theft security system infrastructure, wherein the second functionality provides at least signal transmission capabilities and enables the superordinate anti-theft security system infrastructure to communicate with an handed-over mobile anti-theft device including the sending of a release command to the handed-over anti-theft device, automatically after the handing-over or if at least one release condition is fulfilled.

For achieving at least the object according to the first aspect of the invention, it is further proposed that the first functionality and the second functionality operate at least in part simultaneously and independently of each other.

For achieving at least the object according to the second aspect of the invention, it is further proposed that a wireless signal reception and transmission range being provided by the super-ordinate anti-theft security system infrastructure according to its second functionality and being based on a given performance of the wireless signal transmission and reception arrangement of a respective mobile anti-theft device for communicating with handed-over mobile anti-theft devices substantially exceeds a wireless signal reception range being provided by the superordinate anti-theft security system infrastructure according to its first functionality and being based on a given performance of the wireless signal transmission and reception arrangement of a respective mobile anti-theft device for detecting mobile anti-theft devices by receiving advertising signals therefrom.

Both these proposals may favorably be combined according to the present invention. Accordingly, the first and second functionalities of the superordinate anti-theft security system infrastructure may be characterized by at least one, preferably by both of the following:

the first functionality and the second functionality operate at least in part simultaneously and independently of each other, a wireless signal reception and transmission range being provided by the superordinate anti-theft security system infrastructure according to its second functionality and being based on a given performance of the wireless signal transmission and reception arrangement of a respective mobile anti-theft device for communicating with handed-over mobile anti-theft devices substantially exceeds a wireless signal reception range being provided by the superordinate anti-theft security system infrastructure according to its first functionality and being based on a given performance of the wireless signal transmission and reception arrangement of a respective mobile anti-theft device for detecting mobile anti-theft devices by receiving advertising signals therefrom.

To advantage, the superordinate anti-theft security system infrastructure may comprise plural independent antennas to realize the first functionality and the second functionality. For example, plural multiple transmission and receiving antennas may be used to exploit multipath propagation according to the well-known multiple-input and multiple-output or MIMO approach. This allows sending and receiving more than one data signal simultaneously over the same radio channel.

According to a preferred embodiment, the superordinate anti-theft security system infrastructure comprises at least one first antenna to realize the first functionality and comprises at least one second antenna to realize the second functionality.

For each of said functionalities, plural and antennas may be provided.

According to a preferred embodiment, the superordinate anti-theft security system infrastructure comprises a first wireless signal reception arrangement or a first wireless transmission and reception arrangement of the superordinate anti-theft security system infrastructure to realize the first functionality and comprises a second wireless signal transmission arrangement or a second wireless signal transmission and reception arrangement of the superordinate anti-theft security system infrastructure to realize the second functionality.

According to these proposals, the performance of the superordinate anti-theft security system infrastructure can substantially be increased with respect to the interaction with the mobile anti-theft devices. In particular, having different antennas and different signal reception/transmission arrangements for the first and second functionality gives a high benefit in this respect.

It is further proposed that the second functionality provides wireless signal transmission and reception capabilities and enables the superordinate anti-theft security system infrastructure to communicate with a handed-over mobile anti-theft device including the reception of at least one of status data and identification data from the handed-over mobile anti-theft device, wherein the status data include data indicating whether the electro-mechanical fixation arrangement of the mobile anti-theft device assumes the fixation state or the release state and wherein the identification data include at least one of identification data identifying the handed-over mobile anti-theft device and identification data identifying the merchandise item to which is handed-over merchandise item is attached.

To advantage, one may further provide that the second functionality provides wireless signal transmission and reception capabilities and enables the superordinate anti-theft security system infrastructure to communicate with a handed-over mobile anti-theft device including the reception of an acknowledgement from the handed-over mobile anti-theft device, that its electro-mechanical fixation arrangement has assumed the release state in response to the reception of a release command from the anti-theft security system infrastructure.

According to a preferred embodiment, the superordinate anti-theft security system infrastructure comprises or has associated at least one handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system infrastructure to hand-over detected mobile anti-theft devices having been detected by the first functionality to the second functionality for communicating with the respective handed-over mobile anti-theft device. This controller may be provided by software functionalities or/and hardware functionalities of the infrastructure. Alternatively, the handing-over controller may be provided by a handing-over controller functionality of a remote server which is associated to the superordinate anti-theft security system infrastructure.

Concerning the mentioned release condition, it is proposed that the superordinate anti-theft security system infrastructure or a remote server associated to the superordinate anti-theft security system infrastructure is configured to check whether at least one release condition is fulfilled with respect to an anti-theft device being attached to a merchandise item or with respect to a merchandise item to which an anti-theft device is attached, wherein the at least on release condition comprises at least one of:

- an acknowledgement command or signal was given by means of a user-interface of the superordinate anti-theft security system infrastructure,
- an acknowledgment command or signal was received from superordinate point-of-sales infrastructure of an associated point-of-sales system or a point-of-sales system to which the anti-theft security system belongs, or was received from a superordinate server.

There are many possibilities how the superordinate anti-theft security system infrastructure could be realized in detail. According to preferred embodiments, the superordinate anti-theft security system infrastructure comprises one or plural of:

- at least one anti-theft security infrastructure unit of a first kind comprising a first wireless signal reception arrangement or a first wireless signal transmission and reception arrangement to realize the first functionality based on at least one antenna being included in the anti-theft security infrastructure unit or based on at least one external antenna being associated to the anti-theft security infrastructure unit;
- at least one anti-theft security infrastructure unit of a second kind comprising a second wireless signal transmission arrangement or a second wireless transmission and reception arrangement to realize the second functionality based on at least one antenna being included in the anti-theft security infrastructure unit or based on at least one external antenna being associated to the anti-theft security infrastructure unit;
- at least one anti-theft security infrastructure unit of a third kind which comprises a first wireless signal reception arrangement or a first wireless transmission and reception arrangement to realize the first functionality and comprises a second wireless signal transmission arrangement or a second wireless transmission and reception arrangement to realize the second functionality, wherein the first and second functionalities are realized based on at least one antenna, preferably at least two antennas, being included in the anti-theft security infrastructure unit or based on at least one external antenna, preferably at least two external antennas, being associated to the anti-theft security infrastructure unit.

In this respect, it is further proposed that at least one of the anti-theft security infrastructure unit of the first kind, the anti-theft security infrastructure unit of the second kind and the anti-theft security infrastructure unit of the third kind comprises a handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system infrastructure or another of said anti-theft security infrastructure units to hand-over detected mobile anti-theft devices having been detected by the first functionality to the second functionality for communicating with the respective handed-over mobile anti-theft device. Alternatively, the handing-over controller function may be provided by a remote server interacting with a respective anti-theft security structure unit or units.

Alternatively or additionally, it is proposed in this respect that at least one anti-theft security infrastructure unit of the first kind or the third kind is provided and at least one anti-theft security infrastructure unit of the second kind is provided; wherein the first functionality with related infrastructure hardware including the at least one first antenna provides, on basis of the given performance of the wireless signal transmission and reception arrangement of a respective mobile anti-theft device, for a first wireless signal reception range that enables to receive advertising signals from mobile anti-theft devices and to hand over a respectively detected mobile anti-theft device to the second functionality of the superordinate anti-theft security system infrastructure; wherein the second functionality with related infrastructure hardware including the at least one second antenna provides, on basis of the given performance of the wireless signal transmission and reception arrangement of a respective mobile anti-theft device, for a second wireless signal reception and transmission range that enables to communicate with an handed-over mobile anti-theft device; and wherein the second wireless signal reception and transmission range substantially exceeds the first wireless signal reception range.

To advantage, at least one anti-theft security infrastructure unit of the first or the third kind may be deployed to detect mobile anti-theft devices which enter or are present in a first area of premises having installed the superordinate anti-theft security system infrastructure wherein at least one anti-theft security infrastructure unit of the second kind may be favorably deployed to communication with handed-over mobile anti-theft devices which are present in a second area of said premises. In this respect, it is further proposed that the second area is substantially larger than the first area and comprises the first area. This configuration enables favorable checkout scenarios using point-of-sale self-checkout cash register terminals as well as point-of-sale cash register terminals operated by staff members of a respective shop or the like. For example, at least one of one or plural point-of-sale cash register terminals and at least one of one or plural point-of-sale self-checkout cash register terminals of superordinate point-of-sales infrastructure of an associated point-of-sales system or a point-of-sales system to which the anti-theft security system belongs may be deployed in the first area.

In this respect, it is further proposed that the anti-theft security infrastructure unit of the first or the third kind is connected with or integrated into a point-of-sale cash register terminal or point-of-sale self-checkout cash register terminal.

According to the invention, a conventional anti-theft security system may be retrofitted or upgraded to be an anti-theft security system according to the present invention. In this respect, for achieving at least one of the mentioned objects, the invention provides an anti-theft security infrastructure arrangement comprising at least one anti-theft security infrastructure unit, which is designated and configured for being integrated into superordinate anti-theft security system infrastructure of an anti-theft security system that further comprises:

- a plurality of mobile anti-theft devices, which are configured to be attached to merchandise items to be protected and to wirelessly interact with the superordinate anti-theft security system infrastructure, wherein a respective anti-theft device includes:
  - an electro-mechanical fixation arrangement, which enables the mobile anti-theft device to be fixedly attached to a merchandise item in a fixation state and enables the mobile anti-theft device to be detached or allow detachment from a merchandise item in a release state,
  - a wireless signal transmission and reception arrangement, which is configured to receive wireless signals from the superordinate anti-theft security system infrastructure or a mobile device wirelessly interacting with the superordinate anti-theft security system infrastructure and to transmit wireless signals to the superordinate anti-theft security system infrastructure or the mobile device wirelessly interacting with the superordinate anti-theft security system infrastructure, wherein said wireless signals include advertising signals indicating the presence and availability for communication of the respective mobile anti-theft device,
  - a controller which is configured to interact with the electro-mechanical fixation arrangement and the wireless signal transmission and reception arrangement, wherein the controller is configured to react to commands received as wireless signals from the superordinate anti-theft security system infrastructure or the mobile device wirelessly interacting with the superordinate anti-theft security system infrastructure by the wireless signal transmission and reception arrangement, including to operate the electro-mechanical fixation arrangement to switch-over from the fixation state to the release state in response to a release command received from the anti-theft security system infrastructure;

wherein the at least one anti-theft security infrastructure unit gives particular wireless signal transmission and reception capabilities according to plural functionalities to the superordinate anti-theft security system infrastructure, including a first functionality, which is based on the integration of the anti-theft security infrastructure arrangement, and a second functionality, which is based on the integration of the anti-theft security infrastructure arrangement, such that the first functionality of the superordinate anti-theft security system infrastructure provides at least signal reception capabilities and enables the superordinate anti-theft security system infrastructure to detect mobile anti-theft devices by receiving advertising signals therefrom and to hand over a respectively detected mobile anti-theft device to the second functionality of the superordinate anti-theft security system infrastructure, and such that the second functionality provides at least signal transmission capabilities and enables the superordinate anti-theft security system infrastructure to communicate with an handed-over mobile anti-theft device including the sending of a release command to the handed-over anti-theft device, automatically after the handing-over or if at least one release condition is fulfilled.

For achieving at least the object according to the first aspect of the invention, it is further proposed that the first functionality and the second functionality given to the superordinate anti-theft security system infrastructure operate at least in part simultaneously and independently of each other.

For achieving at least the object according to the second aspect of the invention, it is further proposed that a wireless signal reception and transmission range being provided by the super-ordinate anti-theft security system infrastructure according to the second functionality given to the superordinate anti-theft security system infrastructure and being based on a given performance of the wireless signal transmission and reception arrangement of a respective mobile anti-theft device for communicating with handed-over mobile anti-theft devices substantially exceeds a wireless signal reception range being provided by the superordinate anti-theft security system infrastructure according to the first functionality given to the superordinate anti-theft security system infrastructure and being based on a given performance of the wireless signal transmission and reception arrangement of a respective mobile anti-theft device for detecting mobile anti-theft devices by receiving advertising signals therefrom.

Both these proposals may favorably be combined according to the present invention. Accordingly, the first and second functionalities given to the superordinate anti-theft security system infrastructure are characterized by at least one, preferably both of the following:

- the first functionality and the second functionality operate at least in part simultaneously and independently of each other,
- a wireless signal reception and transmission range being provided by the superordinate anti-theft security system infrastructure according to its second functionality and being based of a given performance of the wireless signal transmission and reception arrangement of a respective mobile anti-theft device for communicating with handed-over mobile anti-theft devices substantially exceeds a wireless signal reception range being provided by the superordinate anti-theft security system infrastructure according to its first functionality and being based of a given performance of the wireless signal transmission and reception arrangement of a respective mobile anti-theft device for detecting mobile anti-theft devices by receiving advertising signals therefrom.

According to a preferred embodiment, the anti-theft security infrastructure arrangement comprises one or plural of:

- at least one anti-theft security infrastructure unit of a first kind comprising a first wireless signal reception arrangement or a first wireless signal transmission and reception arrangement to realize the first functionality based on at least one antenna being included in the anti-theft security infrastructure unit or based on at least one external antenna being associated to the anti-theft security infrastructure unit;
- at least one anti-theft security infrastructure unit of a second kind comprising a second wireless signal transmission arrangement or a second wireless transmission and reception arrangement to realize the second functionality based on at least one antenna being included in the anti-theft security infrastructure unit or based on at least one external antenna being associated to the anti-theft security infrastructure unit;
- at least one anti-theft security infrastructure unit of a third kind which comprises a first wireless signal reception arrangement or a first wireless transmission and reception arrangement to realize the first functionality and comprises a second wireless signal transmission arrangement or a second wireless transmission and reception arrangement to realize the second functionality, wherein the first and second functionalities are realized based on at least one antenna, preferably at least two antennas, being included in the anti-theft security infrastructure unit or based on at least one external antenna, preferably at least two external antennas, being associated to the anti-theft security infrastructure unit.

According to preferred embodiments, the anti-theft security infrastructure arrangement comprises at least one anti-theft security infrastructure unit of the first kind or the third kind and comprises at least one anti-theft security infrastructure unit of the second kind; wherein the first functionality with related infrastructure hardware including at least one antenna provides, on basis of the given performance of the wireless signal transmission and reception arrangement of a respective mobile anti-theft device, for a first wireless signal reception range that enables to receive advertising signals from mobile anti-theft devices and to hand over a respectively detected mobile anti-theft device to the second functionality of the superordinate anti-theft security system infrastructure; wherein the second functionality with related infrastructure hardware including at least one antenna provides, on basis of the given performance of the wireless signal transmission and reception arrangement of a respective mobile anti-theft device, for a second wireless signal reception and transmission range that enables to communicate with an handed-over mobile anti-theft device; and wherein the second wireless signal reception and transmission range substantially exceeds the first wireless signal reception range.

To advantage, the anti-theft security infrastructure arrangement may comprise at least one handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system to hand-over detected mobile anti-theft devices having been detected by the first functionality to the second functionality for communicating with the respective handed-over mobile anti-theft device. The handing-over controller may be included in an anti-theft security infrastructure unit of the anti-theft security infrastructure arrangement. Alternatively, the handing-over controller function may be provided by a remote server interacting with the anti-theft security infrastructure arrangement.

The present invention further provides a point-of-sale system, which comprises an anti-theft security system according to the invention and further comprises superordinate point-of-sales system infrastructure having wireless signal transmission and reception capabilities, wherein the superordinate point-of-sales infrastructure or a remote server associated to the superordinate point-of-sales system infrastructure is configured to wirelessly interact with personal mobile devices such as smart phones to perform payment and check-out procedures with respect to merchandise items to which a respective of said anti-theft devices is attached, wherein the check-out procedures include the sending of a release command to the respective anti-theft device by the respective personal mobile device or by the superordinate anti-theft security system infrastructure according to its second functionality.

The superordinate point-of-sales system infrastructure and the superordinate anti-theft security system infrastructure may be realized at least in part by common infrastructure of the point-of-sales system. Hardware-wise there may be only common infrastructure, with the point-of sales functionalities and the anti-theft security functionalities being realized by corresponding software functionalities running on the same hardware.

As far as certain functions are performed not by the local anti-theft security system or local point-of-sale system in a shop, such as by the local superordinate point-of-sales system infrastructure or the local superordinate anti-theft security system infrastructure deployed in a shop, but instead by a remote server, possibly a cloud server, the local superordinate point-of-sales system infrastructure or the local superordinate anti-theft security system infrastructure is configured to interact with the remote server by means of data communication, so that the required payment and checkout processes including the unlocking of the mobile anti-theft devices are performed in an integral manner.

The present invention further provides a method for operating an anti-theft security system or a point-of-sale system having an anti-theft security function, comprising:

a) fixedly attaching a respective mobile anti-theft device to merchandise items, which includes that the respective mobile anti-theft device is triggered to assume a fixation state, if the respective mobile anti-theft device doesn't yet assume the fixation state, b) transporting at least one of the merchandise items with the respective mobile anti-theft device fixedly attached thereto to a surveillance area, which is defined, on basis of a given performance of a wireless signal transmission and reception arrangement of a respective mobile anti-theft device, by superordinate anti-theft security system infrastructure having wireless signal transmission and reception capabilities;

c) wirelessly monitoring the surveillance area for mobile anti-theft devices entering into or being present in the surveillance area based on wireless advertising signals that are transmitted by mobile anti-theft devices to indicate the presence and availability for communication of the respective mobile anti-theft device, wherein the wirelessly monitor step is performed by a first functionality of the superordinate anti-theft security system infrastructure;

d) handing over a respectively detected mobile anti-theft device being present in the surveillance area to a second functionality of the superordinate anti-theft security system infrastructure for communication between the respective mobile anti-theft device and the superordinate anti-theft security system infrastructure;

e) communicating with the respective handed-over mobile anti-theft device by the superordinate anti-theft security system infrastructure according to its second functionality, including the sending of a release command to the handed-over anti-theft device to trigger that the mobile anti-theft device assumes a release state;

f) detaching the respective mobile anti-theft device from the merchandise item to which it had been fixedly attached, as is enabled by the release state.

To advantage, the wireless monitoring according to step c) and the communicating according to step e) may be performed simultaneously.

According to a preferred embodiment, the wireless monitoring according to step c) involves first hardware of the superordinate anti-theft security system infrastructure that is dedicated to the first functionality and the communicating according to step e) involves second hardware of the superordinate anti-theft security system infrastructure that is dedicated to the second functionality, wherein the first hardware and the second hardware are operated independently of each other.

According to a favorable approach, it is further proposed that the communicating according to step e) is performed with respect to handed-over mobile anti-theft devices being present in an detachment area, which is defined, on basis of a given performance of a wireless signal transmission and reception arrangement of a respective mobile anti-theft device, by the superordinate anti-theft security system infrastructure and which includes and substantially exceeds the surveillance area, and that the wireless monitoring according to step c) is performed with respect to mobile anti-theft devices being present in the surveillance area but not in portions of the detachment area which are not included in the surveillance area.

Depending on the checkout scenario to be implemented, a release command may be sent according to step e) automatically to the handed-over anti-theft device to trigger that the mobile anti-theft device assumes the release state, without first checking that at least one release condition is fulfilled.

According to a different checkout approach, step e) may comprise the substeps:

c1) checking whether at least one predefined release condition is fulfilled with respect to at least one of the respective handed-over mobile anti-theft device, the merchandise item to which the handed-over mobile anti-theft device is fixedly attached and a customer associated to at least one of said mobile anti-theft device and said merchandise item, and c2) sending of the release command to the handed-over anti-theft device to trigger that the mobile anti-theft device assumes the release state only if or after that this at least one predefined release condition is determined to be fulfilled.

The invention will be described below in more detail on the basis of non-limiting illustrative embodiments and variants thereof, with reference to the accompanying drawings, in which.

Figure 3:
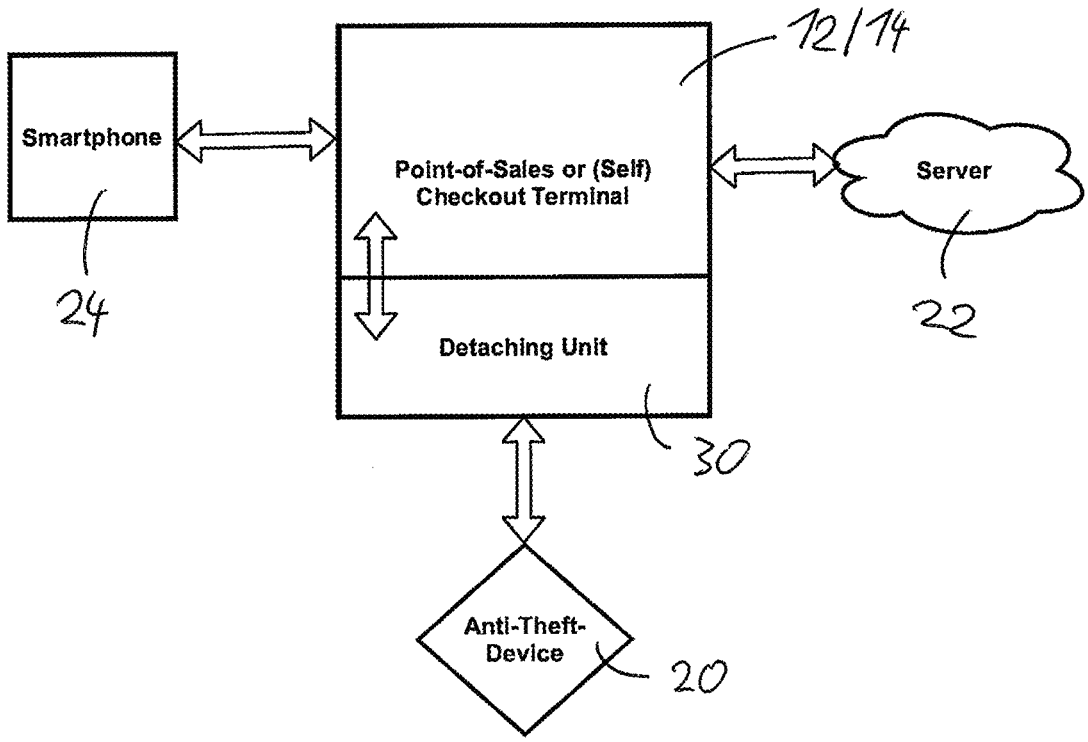

FIG. 3 exemplifies the interaction between a mobile anti-theft device, a detaching unit, a point-of-sale or check-out terminal, a smartphone and a remote server according to a first approach.

Figure 4:
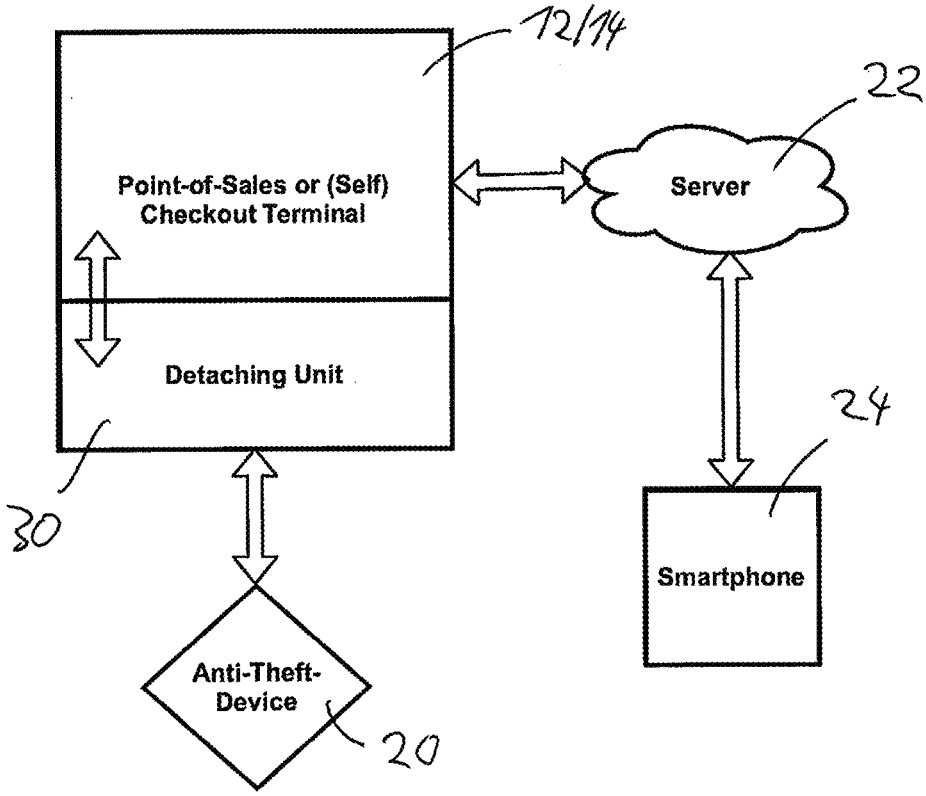

FIG. 4 exemplifies the interaction between a mobile anti-theft device, a detaching unit, a point-of-sale or check-out terminal, a smartphone and a remote server according to a second approach.

Figure 5:
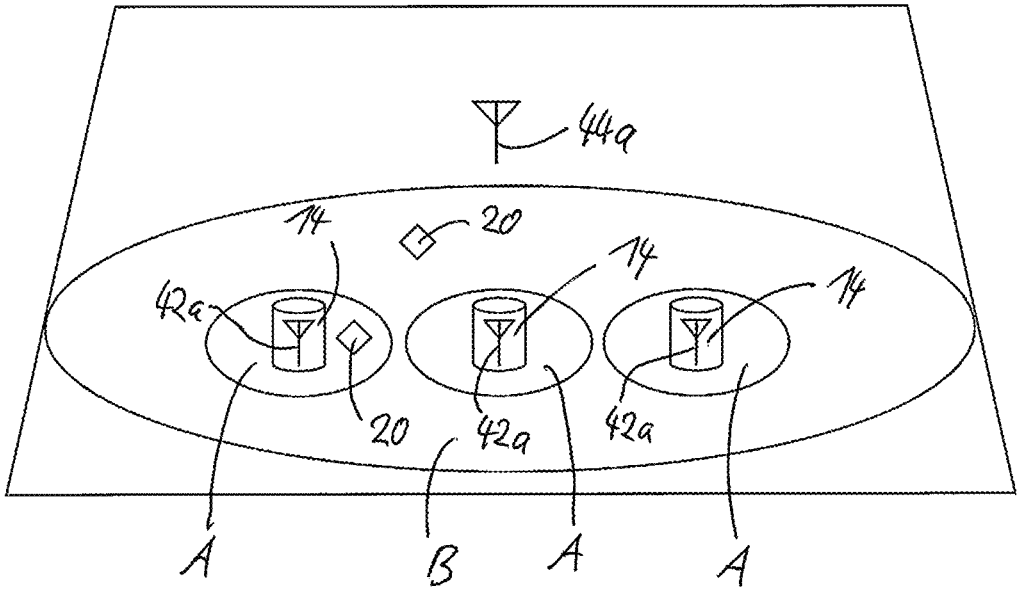

FIG. 5 illustrates a favorable deployment and configuration of components of an anti-theft security system or point-of-sales system and resulting areas (or zone) of different sizes for the interaction with mobile anti-theft devices.

Figure 6:
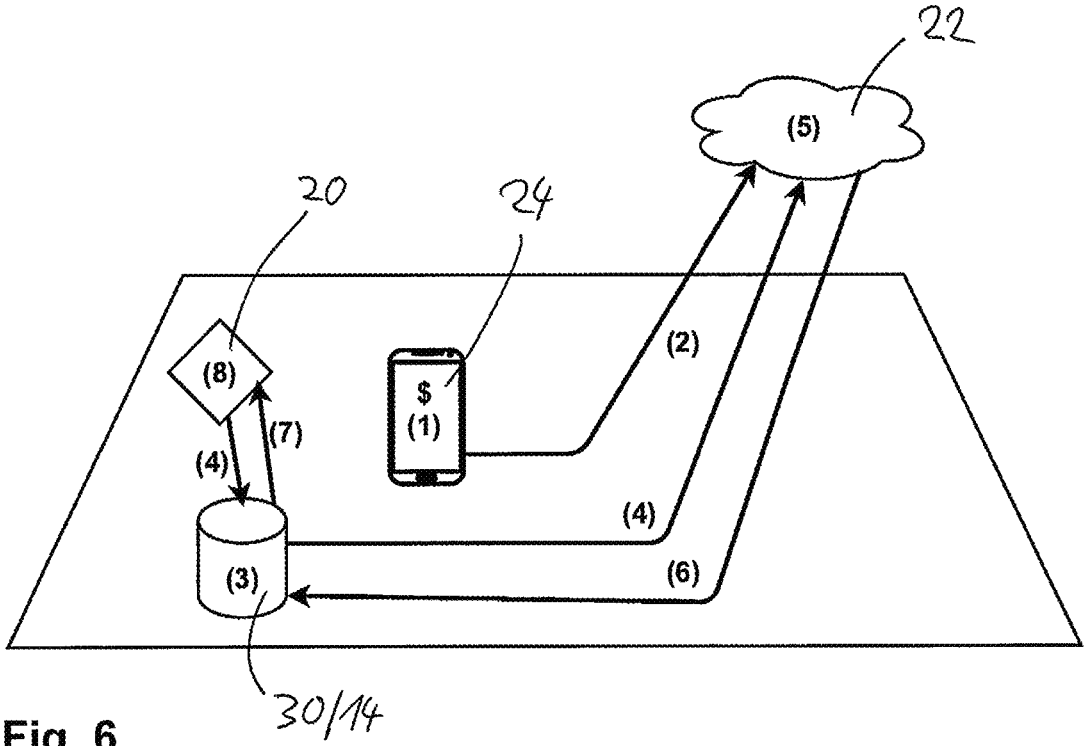

FIG. 6 illustrates schematically a favorable payment and checkout procedure involving a smartphone, a remote server, a detaching unit and a mobile anti-theft device.

The present invention concerns mobile anti-theft devices for retail, which can be denoted as smart anti-theft devices, since the mobile anti-theft devices have and enable functionalities substantially going beyond what is known for many years. One object in this context is to provide a solution that enables customers in a (mobile) self-checkout to remove a respective anti-theft device from the respect product after the payment process without having to rely on the assistance of employees. The term mobile self-checkout refers to checkout scenarios in which the customer uses a personal mobile device like a smartphone in the checkout procedure, and in which the personal mobile device ideally will directly interact with a respective smart (mobile) anti-theft device for unlocking and allowing detachment of it from the respective product.

Such smart (mobile) anti-theft devices have been in place for a number of years, with instances where it was necessary to deviate from an existing checkout process in order to allow all customers in the store to shop smoothly.

For this reason, enhancements of conventional (superordinate) anti-theft security system infrastructure or conventional (superordinate) point-of-sales infrastructure were developed that take over data transmission for a personal mobile device (smartphone) if such a personal mobile device is not available or only available to a limited extent.

Figure 1:
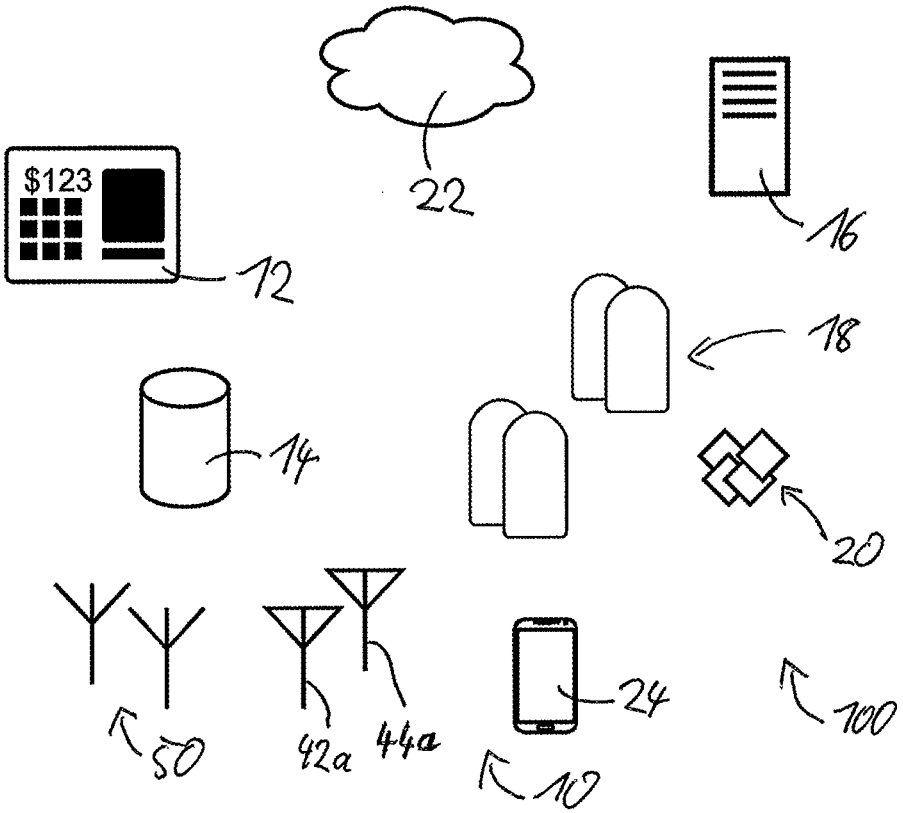
FIG. 1 shows schematically components belonging to or interacting with an anti-theft security system or a point-of-sales system.

Such anti-theft security system infrastructure 10 or point-of-sales system infrastructure 10 may comprise, as is illustrated in FIG. 1, at least one of i) one or plural point-of-sales terminals 12 operated by a cashier, ii) one or plural self-checkout terminals 14, iii) at least one local server 16, iv) one or plural anti-theft detector units 18. A corresponding anti-theft security system 100 or point-of-sales system 100 may comprise such anti-theft security system infrastructure 10 or point-of-sales infrastructure 10 and a plurality of smart (mobile) anti-theft devices 20, which may interact with the at least one anti-theft detector unit 18, to trigger an alarm, if a still locked or activated smart (mobile) anti-theft device 20 approaches or passes a/the anti-theft detector unit 18.

The smart (mobile) anti-theft devices 20 may be of a kind and construction as described and shown in detail in the publications WO 2016/055446 A1, US 2017/0306657 A1, WO 2020/165038 A1, WO 2020/178054 A1, WO 2020/200618 A1 and WO 2021/160710 A1 originating from the present applicant. The disclosure of these publications is included by reference completely into the present disclosure. Also other smart (mobile) anti-theft devices known in the art and providing similar functionalities may be used, of course.

In addition or instead of at least one local server 16, at least one remote server, possibly a cloud server 22 as illustrated in FIG. 1, may be provided. The anti-theft security system infrastructure 10 or point-of-sales system infrastructure 10 and the at least one remote server 22 may be configured to interact with each other directly or indirectly by data communication, possibly using a LAN or WIFI network and the internet. In case of at least one local server 16, the local server 16 and the other components of the anti-theft security system infrastructure 10 or point-of-sales system infrastructure 10 may interact with each other directly or indirectly by data communication, possibly using a LAN or WIFI network. A WIFI network is represented by antennas 50 in FIG. 1

The anti-theft security system 100 or point-of-sales system 100 or/and the at least one remote server 22 may be configured to interact by data communication with personal mobile devices of customers, such as smartphones 24, possibly using the internet and at least one of a WIFI network and a cellular network. Such a personal mobile device 24 may be configured to wirelessly interact with smart (mobile) anti-theft devices 20 in the context of payment and checkout procedures, for unlocking a respective smart (mobile) anti-theft device 20, for which the customer has successfully effected the necessary payment, so that the smart (mobile) anti-theft device 20 can be detached from the product (or merchandise item) having been purchased. In this respect, the personal mobile device 24 may receive by said data communication an opening command or/and an ID identifying the smart (mobile) anti-theft device 20 to be unlocked from the anti-theft security system 100 or point-of-sales system 100 or the remote server 22, for sending it to the respective smart (mobile) anti-theft device 20. This wireless interaction may use a respective Bluetooth functionality of the personal mobile device 24 and of the smart (mobile) anti-theft device 20.

According to the enhancements considered here, the anti-theft security system infrastructure 10 or point-of-sales system infrastructure 10 may be configured to wirelessly interact with smart (mobile) anti-theft devices 20 in the context of payment and checkout procedures, for unlocking a respective smart (mobile) anti-theft device 20, for which the customer has successfully effected the necessary payment, so that the smart (mobile) anti-theft device 20 can be detached from the product (or merchandise item) having been purchased. In this respect, the anti-theft security system infrastructure 10 or point-of-sales system infrastructure 10 may receive by said data communication an opening command or/and an ID identifying the smart (mobile) anti-theft device 20 to be unlocked from the remote server 22, for sending it to the respective smart (mobile) anti-theft device 20. Corresponding wireless signal transmission and reception capabilities of the anti-theft security system infrastructure 10 or point-of-sales system infrastructure 10 e.g. according to a short range or medium range communication standard like a Bluetooth standard are represented by antennas 42*a* and 44*a* in FIG. 1.

Such enhancements and corresponding additional checkout functionalities may be provided by adding one or plural "Detaching Units" (or "Detachment Units") to existing infrastructure and integrating the additional at least one "Detaching Unit" into the existing infrastructure. Such a "Detaching Unit" may be a small device that takes over data transmission for the personal mobile device (smartphone) if such a personal mobile device is not available or only available to a limited extent. Alternatively, such enhancements and corresponding additional checkout functionalities may be provided in conventional (superordinate) anti-theft security system infrastructure or (superordinate) point-of-sales infrastructure essentially by enhancing the software running on existing hardware or be providing new software to run on existing hardware, possibly including the provision of some additional hardware. A further possibility is of course that such infrastructure is provided from the start with such enhancements and corresponding additional checkout functionalities over conventional approaches by the manufacturer or system integrator from which such infrastructure is obtained for being installed in certain premises e.g. of a shop.

Figure 2:
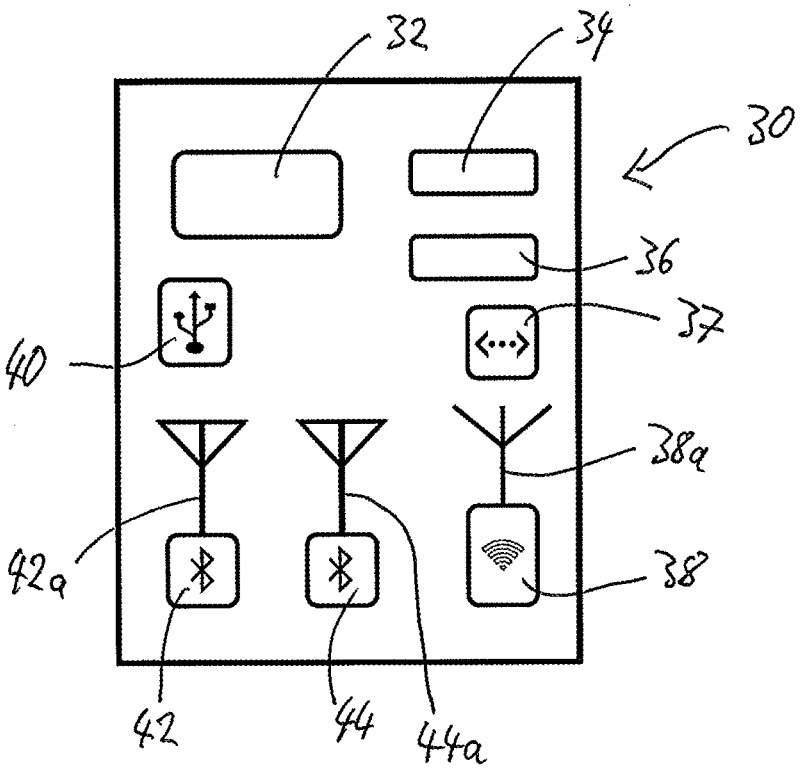
FIG. 2 shows schematically a detaching unit according to one embodiment of the invention.

A "Detaching Unit" 30 as mentioned may typically include, but is not limited to include, the following items, as is illustrated in FIG. 2:

- a microprocessor 32,
- memory (typically RAM memory 34 and ROM memory 36),
- network connection hardware (LAN, WIFI, etc.), preferably internet connection hardware, such as at least one of ethernet hardware 37, WIFI hardware 38 connected with at least one suitable WIFI antenna 38*a* and USB hardware 40, short-range or medium range wireless communication hardware, e.g. comprising at least one communication chip 42, 44 (e.g. according to a Bluetooth standard), for communicating with the smart (mobile) anti-theft devices 20, at least one, preferably two antennas 42*a*, 44*a* connected with the short-range or medium range wireless communication hardware 42, 44, detaching software stored in the ROM memory 36 and configured to be executed by the microprocessor 32.

Of course, the "Detaching Unit" 30 will have obviously necessary and trivial functions or components like a power supply and so forth. According to a favorable approach, the power could be supplied via a USB connector of the USB hardware 40.

It was found that at least two antennas 44*a*, 44*b* increase the performance of the "Detaching Unit" 30 or corresponding functionalities of the infrastructure enormously. In a mobile self checkout scenario, where the customer's smartphone 24 takes over the detaching process (unlocking or opening process) with respect to a particular smart (mobile) anti-theft device 20, the typically only one antenna of the device for Bluetooth communication is usually sufficient. The reason is that the smartphone rarely establishes multiple connections in parallel and the unlocking process is not under any time pressure.

However, if a "Detaching Unit" 30 or corresponding functionalities of the infrastructure are used, such as added to or integrated into a self checkout terminal (SCO) or a classic point-of-sales terminal (POS), it may be that the "Detaching Unit" 30 or corresponding functionalities of the infrastructure must establish connections to plural smart (mobile) anti-theft devices 20 at the same time. This can be up to 10 or even more simultaneous connections, although a typical average number of simultaneous connection may be lower, for example 3-4 simultaneous connections, per checkout process.

For this purpose, plural independent antennas 42*a*, 44*a* may be provided, for example as follows:

one (or at least one) antenna (first antenna) 42*a* is only responsible for reception (receiver).

one (or at least one) other antenna (second antenna) 44*a* is only responsible for transmission (transmitter) and, if provided, for further communications with the smart (mobile) anti-theft device (receiver and transmitter).

The first and second antennas may have associated or belong to dedicated wireless reception/transmission hardware 42 and 44, respectively, including hardware driving the respective antenna with HF signals and hardware receiving HF signals from the respective antenna.

While the "listening" antenna (first antenna) 42*a* constantly scans the environment for new signals of potential smart (mobile) anti-theft devices around the "Detaching Unit" or the respective infrastructure device, the other antenna (second antenna) 44*a* can establish a connection to the found smart (mobile) anti-theft devices and start the detaching process. Especially a bidirectional data communication with the found smart (mobile) anti-theft devices may be provided, so that smart (mobile) anti-theft devices can send data to the "Detaching Unit" 30 or infrastructure (e.g. ID or battery status) and receive data (e.g. commands) therefrom.

By separating the scanning of the environment for new signals of potential smart (mobile) anti-theft devices using the "listening" antenna (first antenna) 42*a* from the establishing of connections to the found smart (mobile) anti-theft devices and the further communications with the found smart (mobile) anti-theft devices for performing the detaching processes using the other antenna (second antenna) 44*a*, different hardware and software can favorably be used. This enable a significantly acceleration of the processes, as the separate hardware and software functionalities are focused on the respective tasks and interference and thereby cases disruptions are less likely to occur. These disruptions can be, for example, data packet collisions, data transmission errors or data packet duplicates.

As already mentioned, it is possible that the "Detaching Unit" 30 is not a peripheral and autonomously operating device. The "Detaching Unit" may be provided by integrated software and hardware of the infrastructure, e.g. in the form of a scalable setup consisting of special hardware and software. The "Detaching Unit" can therefore also be integrated into existing systems, such as POS systems, and share certain hardware components (power, Internet connection, controller, etc.) with other functionalities of the existing system. If the systems do not have (multiple) Bluetooth antennas, these could also be retrofitted e.g. via USB hardware without having to make any far-reaching changes to the system.

In case of an integration, the detaching process may be requested by a superordinate software system, which addresses and controls the connected "Detaching Unit" or detaching software. The "Detaching Unit" or detaching software then handles the detaching process and communicates with related entities, such as a purchase validation server and, after successful authentication, unlocks or opens the respective (mobile) anti-theft device, before sending a (positive/negative) feedback about the success back to the superordinate software system.

Various software functionalities may favorably be provided by one or plural remote servers, which may be realized as cloud servers, possibly cloud servers being set up using a public cloud service like Microsoft Azure or Amazon AWS. The local infrastructure may be configured to interact with such at least one remote server, to achieve a smooth and integral user experience for staff members of a shop as well as for customers of the shop.

FIG. 3 illustrates a mutual interaction by data communication between a smartphone 24 and a point of sales terminal 12 or a self-checkout terminal 14, between the point of sales terminal 12 or self-checkout terminal 14 and a remote server 22 and between a smart (mobile) anti-theft device 20 and a "Detaching Unit" 30 being deployed at and mutually interacting by data communication with the point of sales terminal 12 or self-checkout terminal 14 or alternatively being integrated into the point of sales terminal 12 or self-checkout terminal 14.

FIG. 4 illustrates an alternative preferred configuration, according to which the smartphone 24 mutually interacts by data communication with the remote server 22.

According to both configurations, direct or indirect interaction between the various shown elements is enabled, as is needed for a certain payment and checkout procedure.

The corresponding hardware of the POS system being used in the detaching processes, including e.g. the Bluetooth antennas, can either be controlled directly by the "Detaching Unit" or detaching software or, after request by the "Detaching Unit" or the detaching software, by the POS software. The detaching software may run independently of the POS software or may belong to and be integrated into the POS software.

For certain checkout scenarios, it is favorable that the detaching process may be initiated or must be initiated manually, for example by manually operating a control element like a pushbutton. Such a control element is favorable especially in peripheral use. The corresponding control element may belong to a corresponding "Detaching Unit", which may be configured accordingly.

However, the control element or pushbutton does not have to be physical/peripheral. The manual control or confirmation element can also be part of the software, for example displayed on the monitor of the POS system. Many modern POS systems have touch displays for entering price data or confirming the scanning process. The manual control element of the "Detaching Unit" or detaching software could therefore be designed both physically on the device or infrastructure and digitally. This may be the case, for example, if the "Detaching Unit" is deployed at or if the "Detaching Unit" or detaching software is integrated into a classic point-of-sales terminal (POS) and the cashier has to confirm each detaching process manually. This could, for example, be appropriate to prevent the fully automatic opening of products hidden or inserted by the customer or to carry out an age check beforehand, e.g., for alcoholic products.

To advantage, the "Detaching Unit" or detaching software may have the following modes:

Automatic Mode:

All smart (mobile) anti-theft devices within range are automatically detected and opened immediately.

Manual Mode:

All smart (mobile) anti-theft devices within range are automatically detected, opening takes place after manual confirmation by authorized persons.

Standard Mode:

All smart (mobile) anti-theft devices within range are automatically detected, and opening or unlocking occurs automatically after digital authentication.

These modes and functions of these modes may be provided as indicated in the following table:

| | Mode | | |
|---|---|---|---|
| Functions | Automatic | Manual | Standard |
| Recognizing | Smart (mobile) anti-theft device is detected by first antenna of "Detaching Unit" | Smart (mobile) anti-theft device is detected by first antenna of "Detaching Unit" | Smart (mobile) anti-theft device is detected by first antenna of "Detaching Unit" |
| Establishing Connection | Second Antenna of the "Detaching Unit" establishes a connection to smart (mobile) anti-theft device | Second Antenna of the "Detaching Unit" establishes a connection to smart (mobile) anti-theft device | Second Antenna of the "Detaching Unit" establishes a connection to smart (mobile) anti-theft device |
| Server Check | Data received from smart (mobile) anti-theft device is transferred to server | Data received from smart (mobile) anti-theft device is transferred to server | Data received from smart (mobile) anti-theft device is transferred to server |
| Approval of Opening or Unlocking | Occurs automatically | Manual actuation of control element (e.g. pushbutton) | Authentication from Server |
| Opening or Unlocking | Automatically | Automatically | Automatically |

Preferably, digital authentication is the standard process, such as that opening or unlocking of the respective smart (mobile) anti-theft device is approved and commanded without the need for manual intervention, as soon as the POS system or personal mobile device (smartphone) successfully completes the payment process.

To advantage, the "Detaching Unit" or detaching software may be as a kind of middleware in a mobile smartphone self-checkout, preferably according to the standard mode or a subcategory thereof, namely if the use of Bluetooth (or another nearfield or short range data communication standard, e.g. NFC) by the smartphone or personal mobile device is not possible.

This could be the case due to plural reasons, for example if a) the personal mobile device (smartphone) is too old and does not have a corresponding Bluetooth (or other wireless data communication functionality), or if
b) the customer disabled the Bluetooth (or other wireless data communication functionality), or if
c) the customer has not granted to the checkout application (or app) the necessary access authorization to the Bluetooth functionality (or other wireless data communication functionality) needed to perform the normal payment and checkout procedure, or if
d) the customer doesn't use a checkout application (app) but instead a browser of his personal mobile device (smartphone) to perform the payment and checkout procedure, since a browser usually cannot use the Bluetooth functionality (or other wireless data communication functionality), or if
e) the customer does not wish to transmit Bluetooth data or other data for data protection reasons.

According to the invention, it can be coped with such situations in a favorable manner. In this case, one or more "Detaching Unit(s)" could be located in a spatially designated checkout or detachment zone or distributed over the entire store area. While in the three mentioned modes the transmitting and receiving power of the two antennas of the respective "Detaching Unit" could normally be set to a similarly small distance, usually a nearfield range of <1 meter, the antennas favorably could be configured differently in this particular application, for providing a sufficiently large checkout zone using a medium to high range. Bluetooth enables ranges of 30 m and more.

Scanning for potential smart (mobile) anti-theft devices over the complete checkout zone, possibly the entire shop area is possible, in principle, but has disadvantages. For example, if the entire area is scanned, new smart (mobile) anti-theft devices that are not in checkout with a customer would be found all the time. A large number of unnecessary signals could slow down the system, so that a zone-based solution is preferred, which combines one or plural large checkout zones with one or plural smaller or small scanning zones.

In doing so, the first antenna 42*a* within a certain zone A should have the lowest possible range to really only receive signals (advertising signals) from smart (mobile) anti-theft devices 20 within this zone A and not additionally further signals (advertising signals) from smart (mobile) anti-theft devices located in the rest of the store. This can be ensured, for example, by requiring the customer with the respective smart (mobile) anti-theft device to be present or to enter in a specific area within the zone. For example, this can be a visually prominent "checkout" terminal 14, at which the customer can remove the smart (mobile) anti-theft devices, stow his purchases and dispose the smart (mobile) anti-theft devices. The "checkout terminal" may offer to the customer a convenient "workplace" for these activities.

On the other hand, the second antenna 44*a* may have a substantially higher range. The system could even be designed in such a way that there are several first antennas 42*a* distributed to different positions within the checkout or detachment zone B and only one central second antenna 44*a* covering the checkout or detachment zone. Such a configuration is illustrated in FIG. 5.

According to another possibility, each terminal position has both kind of antennas 42*a*, 44*a*, namely at least one first antenna 42*a* and at least one second antenna 44*a*. For the detaching process or the interaction with a server 16, 22, possibly a remote server or cloud server 22, involved in these procedures, the number and/or positions of the antennas are irrelevant, but the number and/or positions of the antennas may of course be logged and processed together with logged performance data for evaluation purposes.

The customer may perform the purchase and checkout procedure using his personal mobile device, typically a smartphone 24, using a special application or app running thereon. For example, the customer may have a product in his shopping cart. The product is secured by a smart (mobile) anti-theft devices 20 fixedly attached thereto. Now the customer now wants to unlock the smart (mobile) anti-theft device after payment. To do this, he goes to a checkout terminal 14 in the checkout zone.

The smart (mobile) anti-theft device transmits an advertising signal, possibly comprising an ID of the respective smart (mobile) anti-theft device, to the "Detaching Unit" 30 or the detaching functionality of the infrastructure. The "Detaching Unit" or detaching functionality detects via its first antenna 42*a* deployed at or on the terminal that a secured product has entered into or is present in the midfield area. Therefor the "Detaching Unit" may now send this ID via a network connection, possibly an internet connection, to the server, for handing over the respective smart (mobile) anti-theft device to the further procedures to be performed.

At the same time, the personal mobile device or smartphone typically has also sent the successful payment transaction to the server, which verifies the purchase thereafter. According to the checkout scenario considered here, the server sends the verification back to the "Detaching Unit" or the detaching functionality, instead of sending it back to the to the smartphone, so that the smartphone would forward it or would sent a corresponding unlocking command or code to the respective smart (mobile) anti-theft device.

According to the checkout scenario considered here, the "Detaching Unit" or the detaching functionality will now send the unlock command or code via the second antenna 44*a* to the respective smart (mobile) anti-theft device 24, so that the customer can open and remove it from the product he purchased. In this way, the wireless data or signal functionality, preferably the Bluetooth functionality, of the "Detaching Unit" 30 or detaching functionality is used instead of that of the personal mobile device or smartphone 24.

For example, a favorable payment and checkout procedure may involve the following steps, which are illustrated in FIG. 6:

(1) Customer pays secured product using his smartphone 24.
(2) Smartphone 24 sends purchase validation to the server 22.
(3) Customer enters or is in checkout zone at a "Detaching Unit" 30, which possibly is integrated into a self-checkout terminal 14.
(4) "Detaching Unit" 30 detects smart (mobile) anti-theft devices 20 and sends their IDs to the server 22.
(5) Server 22 matches IDs of recognized smart (mobile) anti-theft devices 20 and paid products.
(6) Server 22 sends authentication with validated IDs to "Detaching Unit" 30.
(7) "Detaching Unit" 30 sends unlock commands or codes of validated smart (mobile) anti-theft devices to these smart (mobile) anti-theft devices 20.
(8) These smart (mobile) anti-theft devices 20 unlock or open and can be removed from the respective purchased product.

In this use case, it is necessary that the smart (mobile) anti-theft devices 20 and the products are linked or associated to each other, e.g. by corresponding link data present in a database of the server 22 or/and by corresponding data stored in the respective smart (mobile) anti-theft device 20.

If the checking out procedure shall be based on data stored in the smart (mobile) anti-theft devices 20, such a procedure may be exemplified as follows: If a bottle anti-theft device is attached to a bottle of vodka, the bottle anti-theft device must know that it is linked to a bottle of vodka. If a bottle of vodka is now paid for and an anti-theft device linked to vodka is present in the checkout zone, this anti-theft device can be validated and opened. A anti-theft device linked to Whiskey would therefore not be opened unless Whiskey was paid for. Of course such a linking can appropriately done by using product IDs which may identify one or plural of product information items like product type, product make and so forth.

If the link data are stored in a database of the server 22, it is sufficient if the smart (mobile) anti-theft device 20 stores only an anti-theft device ID, which could be coded hardware wise or could be stored in RAM or ROM memory of the respective smart (mobile) anti-theft device.

It is proposed that a first functionality of anti-theft security system infrastructure (10) provides at least signal reception capabilities and enables the anti-theft security system infrastructure (10) to detect mobile anti-theft devices (20) by receiving advertising signals therefrom and to hand over a respectively detected mobile anti-theft device (20) to a second functionality of the anti-theft security system infrastructure (10), wherein the second functionality provides at least signal transmission capabilities and enables the anti-theft security system infrastructure (10) to communicate with an handed-over mobile anti-theft device (20) including the sending of a release command to the handed-over anti-theft device (20), automatically after the handing-over or if at least one release condition is fulfilled.

According to a preferred embodiment, the first and second functionalities of the anti-theft security system infrastructure are characterized by at least one, preferably both of the following:

the first functionality and the second functionality operate at least in part simultaneously and independently of each other;

a wireless signal reception and transmission range being provided by the superordinate anti-theft security system infrastructure (10) according to its second functionality and being based on a given performance of the wireless signal transmission and reception arrangement of a respective mobile anti-theft device (20) for communicating with handed-over mobile anti-theft devices (20) substantially exceeds a wireless signal reception range being provided by the superordinate anti-theft security system infrastructure according to its first functionality and being based on a given performance of the wireless signal transmission and reception arrangement of a respective mobile anti-theft device (20) for detecting mobile anti-theft devices (20) by receiving advertising signals therefrom.

The present disclosure discloses also the following items:

1. Anti-theft security system (100), comprising:

superordinate anti-theft security system infrastructure (10) having wireless signal transmission and reception capabilities;

a plurality of mobile anti-theft devices (20), which are configured to be attached to merchandise items to be protected and to wirelessly interact with the superordinate anti-theft security system infrastructure, wherein a respective anti-theft device includes:

an electro-mechanical fixation arrangement, which enables the mobile anti-theft device to be fixedly attached to a merchandise item in a fixation state and enables the mobile anti-theft device to be detached or allow detachment from a merchandise item in a release state, a wireless signal transmission and reception arrangement, which is configured to receive wireless signals from the superordinate anti-theft security system infrastructure and to transmit wireless signals to the superordinate anti-theft security system infrastructure, wherein said wireless signals include advertising signals indicating the presence and availability for communication of the respective mobile anti-theft device, a controller which is configured to interact with the electro-mechanical fixation arrangement and the wireless signal transmission and reception arrangement, wherein the controller is configured to react to commands received as wireless signals from the superordinate anti-theft security system infrastructure by the wireless signal transmission and reception arrangement, including to operate the electro-mechanical fixation arrangement to switch-over from the fixation state to the release state in response to a release command received from the anti-theft security system infrastructure, wherein the wireless signal transmission and reception capabilities are provided by plural functionalities of the superordinate anti-theft security system infrastructure (10), wherein a first functionality of the superordinate anti-theft security system infrastructure provides at least signal reception capabilities and enables the superordinate anti-theft security system infrastructure to detect mobile anti-theft devices (20) by receiving advertising signals therefrom and to hand over a respectively detected mobile anti-theft device (20) to a second functionality of the superordinate anti-theft security system infrastructure (10), wherein the second functionality provides at least signal transmission capabilities and enables the superordinate anti-theft security system infrastructure (10) to communicate with an handed-over mobile anti-theft device (20) including the sending of a release command to the handed-over anti-theft device (20), automatically after the handing-over or if at least one release condition is fulfilled.

2. Anti-theft security system according to item 1, wherein the first functionality and the second functionality operate at least in part simultaneously and independently of each other.

3. Anti-theft security system according to item 1 or 2, wherein a wireless signal reception and transmission range being provided by the superordinate anti-theft security system infrastructure (10) according to its second functionality and being based on a given performance of the wireless signal transmission and reception arrangement of a respective mobile anti-theft device (20) for communicating with handed-over mobile anti-theft devices (20) substantially exceeds a wireless signal reception range being provided by the superordinate anti-theft security system infrastructure (10) according to its first functionality and being based on a given performance of the wireless signal transmission and reception arrangement of a respective mobile anti-theft device (20) for detecting mobile anti-theft devices (20) by receiving advertising signals therefrom.

4. Anti-theft security system according to one of items 1 to 3, wherein the superordinate anti-theft security system infrastructure comprises plural independent antennas (42*a*, 44*a*) to realize the first functionality and the second functionality.

5. Anti-theft security system according to one of items 1 to 4, wherein the superordinate anti-theft security system infrastructure comprises at least one first antenna (42*a*) to realize the first functionality and comprises at least one second antenna (44*a*) to realize the second functionality.

6. Anti-theft security system according to one of items 1 to 5, wherein the superordinate anti-theft security system infrastructure comprises a first wireless signal reception arrangement or a first wireless transmission and reception arrangement (42, 42*a*) of the superordinate anti-theft security system infrastructure (10) to realize the first functionality and comprises a second wireless signal transmission arrangement or a second wireless signal transmission and reception arrangement (44, 44*a*) of the superordinate anti-theft security system infrastructure (10) to realize the second functionality.

7. Anti-theft security system according to one of items 1 to 6, wherein the second functionality provides wireless signal transmission and reception capabilities and enables the superordinate anti-theft security system infrastructure (10) to communicate with a handed-over mobile anti-theft device (20) including the reception of at least one of status data and identification data from the handed-over mobile anti-theft device, wherein the status data include data indicating whether the electro-mechanical fixation arrangement of the mobile anti-theft device (20) assumes the fixation state or the release state and wherein the identification data include at least one of identification data identifying the handed-over mobile anti-theft device (20) and identification data identifying the merchandise item to which is handed-over merchandise item is attached.

8. Anti-theft security system according to one of items 1 to 7, wherein the second functionality provides wireless signal transmission and reception capabilities and enables the superordinate anti-theft security system infrastructure (10) to communicate with a handed-over mobile anti-theft device (20) including the reception of an acknowledgement from the handed-over mobile anti-theft device, that its electro-mechanical fixation arrangement has assumed the release state in response to the reception of a release command from the anti-theft security system infrastructure.

9. Anti-theft security system according to one of items 1 to 8, wherein the superordinate anti-theft security system infrastructure (10) comprises or has associated at least one handing-over controller (22), which is configured to hand-over detected mobile anti-theft devices (20) having been detected by the first functionality to the second functionality for communicating with the respective handed-over mobile anti-theft device (20) or which is configured to interact with at least one other handing-over controller of the superordinate anti-theft security system infrastructure to hand-over detected mobile anti-theft devices having been detected by the first functionality to the second functionality for communicating with the respective handed-over mobile anti-theft device.

10. Anti-theft security system according to one of items 1 to 9, wherein the superordinate anti-theft security system infrastructure or a remote server associated thereto is configured to check whether at least one release condition is fulfilled with respect to an anti-theft device (20) being attached to a merchandise item or with respect to a merchandise item to which an anti-theft device (20) is attached, wherein the at least on release condition comprises at least one of:

an acknowledgement command or signal was given by means of a user-interface of the superordinate anti-theft security system infrastructure, an acknowledgment command or signal was received from superordinate point-of-sales infrastructure of an associated point-of-sales system or a point-of-sales system to which the anti-theft security system belongs or was received from a superordinate server (22).

11. Anti-theft security system according to one of items 1 to 10, wherein the superordinate anti-theft security system infrastructure comprises one or plural of:

at least one anti-theft security infrastructure unit of a first kind comprising a first wireless signal reception arrangement or a first wireless signal transmission and reception arrangement to realize the first functionality based on at least one antenna (42*a*) being included in the anti-theft security infrastructure unit or based on at least one external antenna (42*a*) being associated to the anti-theft security infrastructure unit;

at least one anti-theft security infrastructure unit of a second kind comprising a second wireless signal transmission arrangement or a second wireless transmission and reception arrangement to realize the second functionality based on at least one antenna (44*a*) being included in the anti-theft security infrastructure unit or based on at least one external antenna (44*a*) being associated to the anti-theft security infrastructure unit;

at least one anti-theft security infrastructure unit (30) of a third kind which comprises a first wireless signal reception arrangement or a first wireless transmission and reception arrangement to realize the first functionality and comprises a second wireless signal transmission arrangement or a second wireless transmission and reception arrangement to realize the second functionality, wherein the first and second functionalities are realized based on at least one antenna, preferably at least two antennas (42*a*, 44*a*), being included in the anti-theft security infrastructure unit or based on at least one external antenna, preferably at least two external antennas (42*a*, 44*a*), being associated to the anti-theft security infrastructure unit.

12. Anti-theft security system according to item 11, wherein at least one of the anti-theft security infrastructure unit of the first kind, the anti-theft security infrastructure unit of the second kind and the anti-theft security infrastructure unit of the third kind comprises a handing-over controller, which is configured to hand-over detected mobile anti-theft devices (20) having been detected by the first functionality to the second functionality for communicating with the respective handed-over mobile anti-theft device (20) or which is configured to interact with at least one other handing-over controller of the superordinate anti-theft security system infrastructure or another of said anti-theft security infrastructure units to hand-over detected mobile anti-theft devices (20) having been detected by the first functionality to the second functionality for communicating with the respective handed-over mobile anti-theft device.

13. Anti-theft security system according to item 11 or 12, wherein at least one anti-theft security infrastructure unit of the first kind or the third kind is provided and at least one anti-theft security infrastructure unit of the second kind is provided, wherein the first functionality with related infrastructure hardware including the at least one first antenna (42*a*) provides, on basis of the given performance of the wireless signal transmission and reception arrangement of a respective mobile anti-theft device (20), for a first wireless signal reception range that enables to receive advertising signals from mobile anti-theft devices (20) and to hand over a respectively detected mobile anti-theft device (20) to the second functionality of the superordinate anti-theft security system infrastructure;

wherein the second functionality with related infrastructure hardware including the at least one second antenna (44*a*) provides, on basis of the given performance of the wireless signal transmission and reception arrangement of a respective mobile anti-theft device (20), for a second wireless signal reception and transmission range that enables to communicate with an handed-over mobile anti-theft device (20); and wherein the second wireless signal reception and transmission range substantially exceeds the first wireless signal reception range.

14. Anti-theft security system according to one of items 11 to 13, wherein at least one anti-theft security infrastructure unit of the first or the third kind is deployed to detect mobile anti-theft devices (20) which enter or are present in a first area (A) of premises having installed the superordinate anti-theft security system infrastructure, and wherein at least one anti-theft security infrastructure unit of the second kind is deployed to communicate with handed-over mobile anti-theft devices (20) which are present in a second area (B) of said premises, wherein the second area (B) is substantially larger than the first area (A) and comprises the first area (A).

15. Anti-theft security system according to item 14, wherein at least one of one or plural point-of-sale cash register terminals (12) and at least one of one or plural point-of-sale self-checkout cash register terminals (14) of superordinate point-of-sales infrastructure (10) of an associated point-of-sales system (100) or a point-of-sales system (100) to which the anti-theft security system belongs is/are deployed in the first area (A).

16. Anti-theft security system according to item 15, wherein the anti-theft security infrastructure unit of the first or the third kind is connected with or integrated into a point-of-sale cash register terminal (12) or point-of-sale self-checkout cash register terminal (14).

17. Anti-theft security infrastructure arrangement comprising at least one anti-theft security infrastructure unit (30), which is designated and configured for being integrated into superordinate anti-theft security system infrastructure (10) of an anti-theft security system (100) that further comprises:

a plurality of mobile anti-theft devices (20), which are configured to be attached to merchandise items to be protected and to wirelessly interact with the superordinate anti-theft security system infrastructure, wherein a respective anti-theft device includes:

an electro-mechanical fixation arrangement, which enables the mobile anti-theft device to be fixedly attached to a merchandise item in a fixation state and enables the mobile anti-theft device to be detached or allow detachment from a merchandise item in a release state, a wireless signal transmission and reception arrangement, which is configured to receive wireless signals from the superordinate anti-theft security system infrastructure or a mobile device wirelessly interacting with the superordinate anti-theft security system infrastructure and to transmit wireless signals to the superordinate anti-theft security system infrastructure or the mobile device wirelessly interacting with the superordinate anti-theft security system infrastructure, wherein said wireless signals include advertising signals indicating the presence and availability for communication of the respective mobile anti-theft device, a controller which is configured to interact with the electro-mechanical fixation arrangement and the wireless signal transmission and reception arrangement, wherein the controller is configured to react to commands received as wireless signals from the superordinate anti-theft security system infrastructure or the mobile device wirelessly interacting with the superordinate anti-theft security system infrastructure by the wireless signal transmission and reception arrangement, including to operate the electro-mechanical fixation arrangement to switch-over from the fixation state to the release state in response to a release command received from the anti-theft security system infrastructure;

wherein the at least one anti-theft security infrastructure unit (30) gives particular wireless signal transmission and reception capabilities according to plural functionalities to the superordinate anti-theft security system infrastructure (10), including a first functionality, which is based on the integration of the anti-theft security infrastructure arrangement, and a second functionality, which is based on the integration of the anti-theft security infrastructure arrangement, such that the first functionality of the superordinate anti-theft security system infrastructure (10) provides at least signal reception capabilities and enables the superordinate anti-theft security system infrastructure to detect mobile anti-theft devices (20) by receiving advertising signals therefrom and to hand over a respectively detected mobile anti-theft device (20) to the second functionality of the superordinate anti-theft security system infrastructure (10), and such that the second functionality provides at least signal transmission capabilities and enables the superordinate anti-theft security system infrastructure (10) to communicate with an handed-over mobile anti-theft device (20) including the sending of a release command to the handed-over anti-theft device (20), automatically after the handing-over or if at least one release condition is fulfilled.

18. Anti-theft security infrastructure arrangement according to item 17, wherein the first and second functionalities given to the superordinate anti-theft security system infrastructure operate at least in part simultaneously and independently of each other.

19. Anti-theft security infrastructure arrangement according to item 17 or 18, wherein a wireless signal reception and transmission range being provided by the superordinate anti-theft security system infrastructure (10) according to the second functionality given to the superordinate anti-theft security system infrastructure (10) and being based of a given performance of the wireless signal transmission and reception arrangement of a respective mobile anti-theft device (20) for communicating with handed-over mobile anti-theft devices (20) substantially exceeds a wireless signal reception range being provided by the superordinate anti-theft security system infrastructure (10) according to the first functionality superordinate anti-theft security system infrastructure and being based of a given performance of the wireless signal transmission and reception arrangement of a respective mobile anti-theft device (20) for detecting mobile anti-theft devices (20) by receiving advertising signals therefrom.

20. Anti-theft security infrastructure arrangement according to one of items 17 to 19, comprising one or plural of:

at least one anti-theft security infrastructure unit of a first kind comprising a first wireless signal reception arrangement or a first wireless signal transmission and reception arrangement to realize the first functionality based on at least one antenna (42*a*) being included in the anti-theft security infrastructure unit or based on at least one external antenna (42*a*) being associated to the anti-theft security infrastructure unit;

at least one anti-theft security infrastructure unit of a second kind comprising a second wireless signal transmission arrangement or a second wireless transmission and reception arrangement to realize the second functionality based on at least one antenna (44*a*) being included in the anti-theft security infrastructure unit or based on at least one external antenna (44*a*) being associated to the anti-theft security infrastructure unit;

at least one anti-theft security infrastructure unit (30) of a third kind which comprises a first wireless signal reception arrangement or a first wireless transmission and reception arrangement to realize the first functionality and comprises a second wireless signal transmission arrangement or a second wireless transmission and reception arrangement to realize the second functionality, wherein the first and second functionalities are realized based on at least one antenna, preferably at least two antennas (42*a*, 44*a*), being included in the anti-theft security infrastructure unit or based on at least one external antenna, preferably at least two external antennas (42*a*, 44*a*), being associated to the anti-theft security infrastructure unit.

21. Anti-theft security infrastructure arrangement according to item 20, comprising at least one anti-theft security infrastructure unit of the first kind or the third kind and comprising at least one anti-theft security infrastructure unit of the second kind;

wherein the first functionality with related infrastructure hardware including at least one antenna (42*a*) provides, on basis of the given performance of the wireless signal transmission and reception arrangement of a respective mobile anti-theft device (20), for a first wireless signal reception range that enables to receive advertising signals from mobile anti-theft devices (20) and to hand over a respectively detected mobile anti-theft device (20) to the second functionality of the superordinate anti-theft security system infrastructure (10);

wherein the second functionality with related infrastructure hardware including at least one antenna (44*a*) provides, on basis of the given performance of the wireless signal transmission and reception arrangement of a respective mobile anti-theft device (20), for a second wireless signal reception and transmission range that enables to communicate with an handed-over mobile anti-theft device (20); and wherein the second wireless signal reception and transmission range substantially exceeds the first wireless signal reception range.

22. Anti-theft security infrastructure arrangement according to item 20 or 21, comprising at least one handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system to hand-over detected mobile anti-theft devices having been detected by the first functionality to the second functionality for communicating with the respective handed-over mobile anti-theft device.

23. Anti-theft security infrastructure arrangement according to item 22, wherein the handing-over controller is included in an anti-theft security infrastructure unit of the anti-theft security infrastructure arrangement.

24. Point-of-sales system (100), which comprises an anti-theft security system (100) according to one of items 1 to 16 and further comprises superordinate point-of-sales system infrastructure (10) having wireless signal transmission and reception capabilities, wherein the superordinate point-of-sales system infrastructure (10) or a remote server (22) associated thereto is configured to wirelessly interact with personal mobile devices (24) such as smart phones to perform payment and check-out procedures with respect to merchandise items to which a respective of said anti-theft devices (20) is attached, wherein the check-out procedures include the sending of a release command to the respective anti-theft device (20) by the respective personal mobile device (24) or by the superordinate anti-theft security system infrastructure (10) according to its second functionality.

25. Point-of-sales system according to item 24, wherein the superordinate point-of-sales infrastructure (10) and the superordinate anti-theft security system infrastructure (10) are realized at least in part by common infrastructure of the point-of-sales system.

26. Method for operating an anti-theft security system (100) or a point-of-sales system (100) having an anti-theft security function, comprising:

a) fixedly attaching a respective mobile anti-theft device (20) to merchandise items, which includes that the respective mobile anti-theft device (20) is triggered to assume a fixation state, if the respective mobile anti-theft device doesn't yet assume the fixation state;

b) transporting at least one of the merchandise items with the respective mobile anti-theft device (20) fixedly attached thereto to a surveillance area (A), which is defined, on basis of a given performance of a wireless signal transmission and reception arrangement of a respective mobile anti-theft device (20), by superordinate anti-theft security system infrastructure (10) having wireless signal transmission and reception capabilities;

c) wirelessly monitoring the surveillance area (A) for mobile anti-theft devices (20) entering into or being present in the surveillance area (A) based on wireless advertising signals that are transmitted by mobile anti-theft devices (20) to indicate the presence and availability for communication of the respective mobile anti-theft device, wherein the wirelessly monitor step is performed by a first functionality of the superordinate anti-theft security system infrastructure (10);

d) handing over a respectively detected mobile anti-theft device (20) being present in the surveillance area (A) to a second functionality of the superordinate anti-theft security system infrastructure (10) for communication between the respective mobile anti-theft device and the superordinate anti-theft security system infrastructure;

e) communicating with the respective handed-over mobile anti-theft device (20) by the superordinate anti-theft security system infrastructure (10) according to its second functionality, including the sending of a release command to the handed-over anti-theft device (20) to trigger that the mobile anti-theft device (20) assumes a release state;

f) detaching the respective mobile anti-theft device (20) from the merchandise item to which it had been fixedly attached, as is enabled by the release state.

27. Method according to item 26, wherein the wireless monitoring according to step c) and the communicating according to step e) are performed simultaneously.

28. Method according to item 26 or 27, wherein the wireless monitoring according to step c) involves first hardware (42, 42*a*) of the superordinate anti-theft security system infrastructure (10) that is dedicated to the first functionality and the communicating according to step e) involves second hardware (44, 44*a*) of the superordinate anti-theft security system infrastructure (10) that is dedicated to the second functionality, wherein the first hardware and the second hardware are operated independently of each other.

29. Method according to one of items 26 to 28, wherein the communicating according to step e) is performed with respect to handed-over mobile anti-theft devices (20) being present in an detachment area (B), which is defined, on basis of a given performance of a wireless signal transmission and reception arrangement of a respective mobile anti-theft device (20), by the superordinate anti-theft security system infrastructure (10) and which includes and substantially exceeds the surveillance area (A), and wherein the wireless monitoring according to step c) is performed with respect to mobile anti-theft devices (20) being present in the surveillance area (B) but not in portions of the detachment area which are not included in the surveillance area (A).

30. Method according to one of items 26 to 29, wherein a release command is sent according to step e) automatically to the handed-over anti-theft device (20) to trigger that the mobile anti-theft device (20) assumes the release state, without first checking that at least one release condition is fulfilled.

31. Method according to one of items 26 to 29, wherein step e) comprises the substeps:

c1) checking whether at least one predefined release condition is fulfilled with respect to at least one of the respective handed-over mobile anti-theft device (20), the merchandise item to which the handed-over mobile anti-theft device is fixedly attached and a customer associated to at least one of said mobile anti-theft device (20) and said merchandise item, and c2) sending of the release command to the handed-over anti-theft device (20) to trigger that the mobile anti-theft device (20) assumes the release state only if or after that this at least one predefined release condition is determined to be fulfilled.

The invention claimed is:

1. Anti-theft security system, comprising:

a superordinate anti-theft security system infrastructure having wireless signal transmission and reception capabilities; and a plurality of mobile anti-theft devices, each of which are configured to be attached to merchandise items to be protected and to wirelessly interact with the superordinate anti-theft security system infrastructure, wherein a respective anti-theft device includes:

an electro-mechanical fixation arrangement, which enables the mobile anti-theft device to be fixedly attached to a merchandise item in a fixation state and enables the mobile anti-theft device to be detached or allow detachment from a merchandise item in a release state;

a wireless signal transmission and reception arrangement, which is configured to receive wireless signals from the superordinate anti-theft security system infrastructure and to transmit wireless signals to the superordinate anti-theft security system infrastructure, wherein said wireless signals include advertising signals indicating the presence and availability for communication of the respective mobile anti-theft device; and a controller which is configured to interact with the electro-mechanical fixation arrangement and the wireless signal transmission and reception arrangement, wherein the controller is configured to react to commands received as wireless signals from the superordinate anti-theft security system infrastructure by the wireless signal transmission and reception arrangement, including to operate the electro-mechanical fixation arrangement to switch-over from the fixation state to the release state in response to a release command received from the anti-theft security system infrastructure, wherein the wireless signal transmission and reception capabilities are provided by plural functionalities of the superordinate anti-theft security system infrastructure, wherein a first functionality of the superordinate anti-theft security system infrastructure provides at least signal reception capabilities and enables the superordinate anti-theft security system infrastructure to detect mobile anti-theft devices by receiving advertising signals therefrom and to hand over a respectively detected mobile anti-theft device to a second functionality of the superordinate anti-theft security system infrastructure, wherein the second functionality provides at least signal transmission capabilities and enables the superordinate anti-theft security system infrastructure to communicate with a handed-over mobile anti-theft device including the sending of a release command to the handed-over anti-theft device, automatically after the handing-over or if at least one release condition is fulfilled, and wherein the first and second functionalities of the superordinate anti-theft security system infrastructure are characterized by at least one of the following:

the first functionality and the second functionality operate at least in part simultaneously and independently of each other;

a wireless signal reception and transmission range being provided by the superordinate anti-theft security system infrastructure according to its second functionality and being based on a given performance of the wireless signal transmission and reception arrangement of a respective mobile anti-theft device for communicating with handed-over mobile anti-theft devices substantially exceeds a wireless signal reception range being provided by the superordinate anti-theft security system infrastructure according to its first functionality and being based on a given performance of the wireless signal transmission and reception arrangement of a respective mobile anti-theft device for detecting mobile anti-theft devices by receiving advertising signals therefrom.

2. Anti-theft security system according to claim 1, wherein the superordinate anti-theft security system infrastructure comprises plural independent antennas to realize the first functionality and the second functionality.

3. Anti-theft security system according to claim 1, wherein the superordinate anti-theft security system infrastructure comprises at least one first antenna to realize the first functionality and comprises at least one second antenna to realize the second functionality.

4. Anti-theft security system according to claim 1, wherein the superordinate anti-theft security system infrastructure comprises a first wireless signal reception arrangement or a first wireless transmission and reception arrangement of the superordinate anti-theft security system infrastructure to realize the first functionality and comprises a second wireless signal transmission arrangement or a second wireless signal transmission and reception arrangement of the superordinate anti-theft security system infrastructure to realize the second functionality.

5. Anti-theft security system according to claim 1, wherein the second functionality provides wireless signal transmission and reception capabilities and enables the superordinate anti-theft security system infrastructure to communicate with a handed-over mobile anti-theft device including the reception of at least one of status data and identification data from the handed-over mobile anti-theft device, wherein the status data include data indicating whether the electro-mechanical fixation arrangement of the mobile anti-theft device assumes the fixation state or the release state, and wherein the identification data include at least one of identification data identifying the handed-over mobile anti-theft device and identification data identifying the merchandise item to which is handed-over merchandise item is attached.

6. Anti-theft security system according to claim 1, wherein the second functionality provides wireless signal transmission and reception capabilities and enables the superordinate anti-theft security system infrastructure to communicate with a handed-over mobile anti-theft device including the reception of an acknowledgement from the handed-over mobile anti-theft device, that its electro-mechanical fixation arrangement has assumed the release state in response to the reception of a release command from the anti-theft security system infrastructure.

7. Anti-theft security system according to claim 1, wherein the superordinate anti-theft security system infrastructure comprises or has associated at least one handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system infrastructure to hand-over detected mobile anti-theft devices having been detected by the first functionality to the second functionality for communicating with the respective handed-over mobile anti-theft device.

8. Anti-theft security system according to claim 1, wherein the superordinate anti-theft security system infrastructure or a remote server associated thereto is configured to check whether at least one release condition is fulfilled with respect to an anti-theft device being attached to a merchandise item or with respect to a merchandise item to which an anti-theft device is attached, wherein the at least on release condition comprises at least one of:

an acknowledgement command or signal was given by means of a user-interface of the superordinate anti-theft security system infrastructure, an acknowledgment command or signal was received from superordinate point-of-sales infrastructure of an associated point-of-sales system or a point-of-sales system to which the anti-theft security system belongs or was received from a superordinate server.

9. Anti-theft security system according to claim 1, wherein the superordinate anti-theft security system infrastructure comprises one or plural of:

at least one anti-theft security infrastructure unit of a first kind comprising a first wireless signal reception arrangement or a first wireless signal transmission and reception arrangement to realize the first functionality based on at least one antenna being included in the anti-theft security infrastructure unit or based on at least one external antenna being associated to the anti-theft security infrastructure unit; or at least one anti-theft security infrastructure unit of a second kind comprising a second wireless signal transmission arrangement or a second wireless transmission and reception arrangement to realize the second functionality based on the at least one antenna being included in the anti-theft security infrastructure unit or based on the at least one external antenna being associated to the anti-theft security infrastructure unit; or at least one anti-theft security infrastructure unit of a third kind which comprises the first wireless signal reception arrangement or the first wireless transmission and reception arrangement to realize the first functionality and comprises the second wireless signal transmission arrangement or the second wireless transmission and reception arrangement to realize the second functionality, wherein the first and second functionalities are realized based on the at least one antenna being included in the anti-theft security infrastructure unit or based on the at least one external antenna being associated to the anti-theft security infrastructure unit.

10. Anti-theft security system according to claim 9, wherein at least one of the anti-theft security infrastructure unit of the first kind, the anti-theft security infrastructure unit of the second kind and the anti-theft security infrastructure unit of the third kind comprises a handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system infrastructure or another of said anti-theft security infrastructure units to hand-over detected mobile anti-theft devices having been detected by the first functionality to the second functionality for communicating with the respective handed-over mobile anti-theft device.

11. Anti-theft security system according to claim 9, wherein at least one anti-theft security infrastructure unit of the first kind or the third kind is provided and at least one anti-theft security infrastructure unit of the second kind is provided, wherein the first functionality with related infrastructure hardware including the at least one antenna provides, on basis of the given performance of the wireless signal transmission and reception arrangement of a respective mobile anti-theft device, for a first wireless signal reception range that enables to receive advertising signals from mobile anti-theft devices and to hand over a respectively detected mobile anti-theft device to the second functionality of the superordinate anti-theft security system infrastructure, wherein the second functionality with related infrastructure hardware including the at least one antenna provides, on basis of the given performance of the wireless signal transmission and reception arrangement of a respective mobile anti-theft device, for a second wireless signal reception and transmission range that enables to communicate with a handed-over mobile anti-theft device, wherein the second wireless signal reception and transmission range substantially exceeds the first wireless signal reception range.

12. Anti-theft security system according to claim 9, wherein at least one anti-theft security infrastructure unit of the first or the third kind is deployed to detect mobile anti-theft devices which enter or are present in a first area of premises having installed the superordinate anti-theft security system infrastructure, wherein at least one anti-theft security infrastructure unit of the second kind is deployed to communicate with handed-over mobile anti-theft devices which are present in a second area of said premises, and wherein the second area is substantially larger than the first area and comprises the first area.

13. Anti-theft security system according to claim 12, wherein at least one of one or plural point-of-sale cash register terminals and at least one of one or plural point-of-sale self-checkout cash register terminals of superordinate point-of-sales infrastructure of an associated point-of-sales system or a point-of-sales system to which the anti-theft security system belongs is/are deployed in the first area.

14. Anti-theft security system according to claim 13, wherein the anti-theft security infrastructure unit of the first or the third kind is connected with or integrated into a point-of-sale cash register terminal or point-of-sale self-checkout cash register terminal.

15. Anti-theft security infrastructure arrangement comprising at least one anti-theft security infrastructure unit, which is designated and configured for being integrated into superordinate anti-theft security system infrastructure of an anti-theft security system that further comprises:

a plurality of mobile anti-theft devices, which are configured to be attached to merchandise items to be protected and to wirelessly interact with the superordinate anti-theft security system infrastructure, wherein a respective anti-theft device includes:

an electro-mechanical fixation arrangement, which enables the mobile anti-theft device to be fixedly attached to a merchandise item in a fixation state and enables the mobile anti-theft device to be detached or allow detachment from a merchandise item in a release state;

a wireless signal transmission and reception arrangement, which is configured to receive wireless signals from the superordinate anti-theft security system infrastructure or a mobile device wirelessly interacting with the superordinate anti-theft security system infrastructure and to transmit wireless signals to the superordinate anti-theft security system infrastructure or the mobile device wirelessly interacting with the superordinate anti-theft security system infrastructure, wherein said wireless signals include advertising signals indicating the presence and availability for communication of the respective mobile anti-theft device, and a controller which is configured to interact with the electro-mechanical fixation arrangement and the wireless signal transmission and reception arrangement, wherein the controller is configured to react to commands received as wireless signals from the superordinate anti-theft security system infrastructure or the mobile device wirelessly interacting with the superordinate anti-theft security system infrastructure by the wireless signal transmission and reception arrangement, including to operate the electro-mechanical fixation arrangement to switch-over from the fixation state to the release state in response to a release command received from the anti-theft security system infrastructure, wherein the at least one anti-theft security infrastructure unit gives particular wireless signal transmission and reception capabilities according to plural functionalities to the superordinate anti-theft security system infrastructure, including a first functionality, which is based on the integration of the anti-theft security infrastructure arrangement, and a second functionality, which is based on the integration of the anti-theft security infrastructure arrangement, such that the first functionality of the superordinate anti-theft security system infrastructure provides at least signal reception capabilities and enables the superordinate anti-theft security system infrastructure to detect mobile anti-theft devices by receiving advertising signals therefrom and to hand over a respectively detected mobile anti-theft device to the second functionality of the superordinate anti-theft security system infrastructure, and such that the second functionality provides at least signal transmission capabilities and enables the superordinate anti-theft security system infrastructure to communicate with an handed-over mobile anti-theft device including the sending of a release command to the handed-over anti-theft device, automatically after the handing-over or if at least one release condition is fulfilled, and wherein the first and second functionalities given to the superordinate anti-theft security system infrastructure are characterized by at least one of the following:

the first functionality and the second functionality operate at least in part simultaneously and independently of each other;

a wireless signal reception and transmission range being provided by the superordinate anti-theft security system infrastructure according to its second functionality and being based of a given performance of the wireless signal transmission and reception arrangement of a respective mobile anti-theft device for communicating with handed-over mobile anti-theft devices substantially exceeds a wireless signal reception range being provided by the superordinate anti-theft security system infrastructure according to its first functionality and being based of a given performance of the wireless signal transmission and reception arrangement of a respective mobile anti-theft device for detecting mobile anti-theft devices by receiving advertising signals therefrom.

16. Anti-theft security infrastructure arrangement according to claim 15, comprising one or plural of:

at least one anti-theft security infrastructure unit of a first kind comprising a first wireless signal reception arrangement or a first wireless signal transmission and reception arrangement to realize the first functionality based on at least one antenna being included in the anti-theft security infrastructure unit or based on at least one external antenna being associated to the anti-theft security infrastructure unit; or at least one anti-theft security infrastructure unit of a second kind comprising a second wireless signal transmission arrangement or a second wireless transmission and reception arrangement to realize the second functionality based on the at least one antenna being included in the anti-theft security infrastructure unit or based on the at least one external antenna being associated to the anti-theft security infrastructure unit; or at least one anti-theft security infrastructure unit of a third kind which comprises the first wireless signal reception arrangement or the first wireless transmission and reception arrangement to realize the first functionality and comprises the second wireless signal transmission arrangement or the second wireless transmission and reception arrangement to realize the second functionality, wherein the first and second functionalities are realized based on at the least one antenna being included in the anti-theft security infrastructure unit or based on the at least one external antenna being associated to the anti-theft security infrastructure unit.

17. Anti-theft security infrastructure arrangement according to claim 16, comprising at least one anti-theft security infrastructure unit of the first kind or the third kind and comprising at least one anti-theft security infrastructure unit of the second kind, wherein the first functionality with related infrastructure hardware including the at least one antenna provides, on basis of the given performance of the wireless signal transmission and reception arrangement of a respective mobile anti-theft device, for a first wireless signal reception range that enables to receive advertising signals from mobile anti-theft devices and to hand over a respectively detected mobile anti-theft device to the second functionality of the superordinate anti-theft security system infrastructure, wherein the second functionality with related infrastructure hardware including the at least one antenna provides, on basis of the given performance of the wireless signal transmission and reception arrangement of a respective mobile anti-theft device, for a second wireless signal reception and transmission range that enables to communicate with a handed-over mobile anti-theft device, and wherein the second wireless signal reception and transmission range substantially exceeds the first wireless signal reception range.

18. Anti-theft security infrastructure arrangement according to claim 16, comprising at least one handing-over controller, which is configured to hand-over detected mobile anti-theft devices having been detected by the first functionality to the second functionality for communicating with the respective handed-over mobile anti-theft device or which is configured to interact with at least one other handing-over controller of the superordinate anti-theft security system to hand-over detected mobile anti-theft devices having been detected by the first functionality to the second functionality for communicating with the respective handed-over mobile anti-theft device.

19. Anti-theft security infrastructure arrangement according to claim 18, wherein the handing-over controller is included in an anti-theft security infrastructure unit of the anti-theft security infrastructure arrangement.

20. Point-of-sales system, which comprises an anti-theft security system according to claim 1 and further comprises superordinate point-of-sales system infrastructure having wireless signal transmission and reception capabilities, wherein the superordinate point-of-sales system infrastructure or a remote server associated thereto is configured to wirelessly interact with personal mobile devices such as smart phones to perform payment and check-out procedures with respect to merchandise items to which a respective of said anti-theft devices is attached, wherein the check-out procedures include the sending of a release command to the respective anti-theft device by the respective personal mobile device or by the superordinate anti-theft security system infrastructure according to its second functionality.

21. Point-of-sales system according to claim 20, wherein the superordinate point-of-sales infrastructure and the superordinate anti-theft security system infrastructure are realized at least in part by common infrastructure of the point-of-sales system.

22. Method for operating an anti-theft security system or a point-of-sales system having an anti-theft security function, comprising:

a) fixedly attaching a respective mobile anti-theft device to merchandise items, which includes that the respective mobile anti-theft device is triggered to assume a fixation state, if the respective mobile anti-theft device does not yet assume the fixation state;

b) transporting at least one of the merchandise items with the respective mobile anti-theft device fixedly attached thereto to a surveillance area, which is defined, on basis of a given performance of a wireless signal transmission and reception arrangement of a respective mobile anti-theft device, by superordinate anti-theft security system infrastructure having wireless signal transmission and reception capabilities;

c) wirelessly monitoring the surveillance area for mobile anti-theft devices entering into or being present in the surveillance area based on wireless advertising signals that are transmitted by mobile anti-theft devices to indicate the presence and availability for communication of the respective mobile anti-theft device, wherein the wirelessly monitoring step is performed by a first functionality of the superordinate anti-theft security system infrastructure;

d) handing over a respectively detected mobile anti-theft device being present in the surveillance area to a second functionality of the superordinate anti-theft security system infrastructure for communication between the respective mobile anti-theft device and the superordinate anti-theft security system infrastructure;

e) communicating with the respective handed-over mobile anti-theft device by the superordinate anti-theft security system infrastructure according to its second functionality, including the sending of a release command to the handed-over anti-theft device to trigger that the mobile anti-theft device assumes a release state; and f) detaching the respective mobile anti-theft device from the merchandise item to which it had been fixedly attached, as is enabled by the release state.

23. Method according to claim 22, wherein the wireless monitoring according to step c) and the communicating according to step e) are performed simultaneously.

24. Method according to claim 22, wherein the wireless monitoring according to step c) involves first hardware of the superordinate anti-theft security system infrastructure that is dedicated to the first functionality and the communicating according to step e) involves second hardware of the superordinate anti-theft security system infrastructure that is dedicated to the second functionality, wherein the first hardware and the second hardware are operated independently of each other.

25. Method according to claim 22, wherein the communicating according to step e) is performed with respect to handed-over mobile anti-theft devices being present in an detachment area, which is defined, on basis of a given performance of a wireless signal transmission and reception arrangement of a respective mobile anti-theft device, by the superordinate anti-theft security system infrastructure and which includes and substantially exceeds the surveillance area, and wherein the wireless monitoring according to step c) is performed with respect to mobile anti-theft devices being present in the surveillance area but not in portions of the detachment area which are not included in the surveillance area.

26. Method according to claim 22, wherein a release command is sent according to step e) automatically to the handed-over anti-theft device to trigger that the mobile anti-theft device assumes the release state, without first checking that at least one release condition is fulfilled.

27. Method according to claim 22, wherein step e) comprises the substeps:

c1) checking whether at least one predefined release condition is fulfilled with respect to at least one of the respective handed-over mobile anti-theft device, the merchandise item to which the handed-over mobile anti-theft device is fixedly attached and a customer associated to at least one of said mobile anti-theft device and said merchandise item; and c2) sending of the release command to the handed-over anti-theft device to trigger that the mobile anti-theft device assumes the release state only if or after that this at least one predefined release condition is determined to be fulfilled.

* * * * *